US009809366B2

(12) United States Patent
Prince et al.

(10) Patent No.: US 9,809,366 B2
(45) Date of Patent: Nov. 7, 2017

(54) STACKABLE TRAYS FOR JUGS, STACKED ARRANGEMENTS AND STACKING METHODS

(71) Applicant: Parmalat Canada Inc., Etobicoke (CA)

(72) Inventors: Sidney Scott Prince, Hamilton (CA); Lee Scott Hoover, Toronto (CA); Antonino Cugliari, Brampton (CA)

(73) Assignee: PARMALAT CANADA INC., Etobicoke (CA)

( * ) Notice: Subject to any disclaimer, the term of this patent is extended or adjusted under 35 U.S.C. 154(b) by 25 days.

(21) Appl. No.: 14/136,802

(22) Filed: Dec. 20, 2013

(65) Prior Publication Data

US 2014/0197064 A1 Jul. 17, 2014

Related U.S. Application Data

(60) Provisional application No. 61/751,377, filed on Jan. 11, 2013, provisional application No. 61/787,960,
(Continued)

(51) Int. Cl.
*B65D 71/70* (2006.01)
*B65D 1/36* (2006.01)
(Continued)

(52) U.S. Cl.
CPC ..... *B65D 71/70* (2013.01); *B65B 5/068* (2013.01); *B65B 21/02* (2013.01); *B65D 1/36* (2013.01);
(Continued)

(58) Field of Classification Search
CPC ..... B65D 71/70; B65D 1/36; B65D 21/0231; B65D 21/023; B65D 21/048
(Continued)

(56) References Cited

U.S. PATENT DOCUMENTS 2,641,374 A * 6/1953 Der Yuen ..... 215/10
3,369,688 A 2/1968 Dike
(Continued)

FOREIGN PATENT DOCUMENTS

CA 2002417 5/1990
CA 2030247 8/1991
(Continued)

OTHER PUBLICATIONS

Stackable bottle holders, draining tray sold separately; http://www.baderbrewing.com/products/beer-bottling-wine-bottles-drying-racks/fastrack-stackable-bottle-drainer; Oct. 23, 2013.
(Continued)

*Primary Examiner* — Jeffrey Allen
*Assistant Examiner* — Jennifer Castriotta
(74) *Attorney, Agent, or Firm* — Banner & Witcoff, Ltd.

(57) ABSTRACT

Stackable trays for jugs, stacked arrangements and stacking methods are disclosed. A tray has a first surface to support a bottom of one or more jugs, and could include jug receiving cells. A collar could extend downwardly from a second surface opposite the first surface and have at least one notch sized to receive a portion of a handle of a respective jug located beneath each jug receiving cell. Load transfer to the handles of the jugs below the second surface could be provided by load transfer structures, such as the collars in one embodiment, which extend from the second surface to engage the jugs. A stacked arrangement includes multiple layers of jugs with a respective stackable tray between adjacent layers of the multiple layers. The trays could thus be used in stacking or otherwise arranging jugs in multiple layers.

21 Claims, 14 Drawing Sheets

Related U.S. Application Data filed on Mar. 15, 2013, provisional application No. 61/892,630, filed on Oct. 18, 2013.

(51) Int. Cl.

| | |
|---|---|
| ***B65D 21/04*** | (2006.01) |
| ***B65D 21/02*** | (2006.01) |
| ***B65B 21/02*** | (2006.01) |
| ***B65B 5/06*** | (2006.01) |
| ***B65D 1/40*** | (2006.01) |

(52) U.S. Cl.

CPC ..... *B65D 1/40* (2013.01); *B65D 21/023* (2013.01); *B65D 21/0231* (2013.01); *B65D 21/048* (2013.01)

(58) Field of Classification Search

USPC ..... 206/509, 501, 505, 508, 510, 514, 519; 220/507, 509, 513, 514, 519, DIG. 15

See application file for complete search history.

(56) References Cited

U.S. PATENT DOCUMENTS

| | | | | |
|---|---|---|---|---|
| 3,391,814 | A * | 7/1968 | Box | 220/519 |
| 3,482,756 | A * | 12/1969 | Collie | 229/406 |
| 4,037,722 | A | 7/1977 | Bremer | |
| 4,256,224 | A | 3/1981 | Hirota | |
| 4,360,231 | A | 11/1982 | Bolin | |
| 4,567,981 | A * | 2/1986 | Headon | A47F 5/118 206/429 |
| 4,700,837 | A * | 10/1987 | Hammett | B65D 1/243 206/203 |
| 4,805,793 | A | 2/1989 | Brandt et al. | |
| 4,928,841 | A | 5/1990 | Arthurs | |
| 5,064,101 | A * | 11/1991 | Richter et al. | 222/143 |
| 5,259,509 | A | 11/1993 | Boal, Jr. et al. | |
| 5,330,050 | A | 7/1994 | Stansbury, Jr. | |
| 5,377,862 | A | 1/1995 | Oakes et al. | |
| 5,645,169 | A | 7/1997 | Dull et al. | |
| 5,673,792 | A | 10/1997 | Aikio | |
| 6,279,770 | B1 * | 8/2001 | Osbakk et al. | 220/519 |
| 6,290,057 | B1 | 9/2001 | Hurley | |
| 6,367,645 | B1 | 4/2002 | Trygg | |
| D461,719 | S * | 8/2002 | Nicodemus et al. | D9/533 |
| 6,582,179 | B1 * | 6/2003 | Simkowski | B65G 57/005 108/53.1 |
| 7,017,746 | B2 * | 3/2006 | Apps | 206/509 |
| 7,467,714 | B2 | 12/2008 | Slat et al. | |
| D594,660 | S | 6/2009 | Lindstrom | |
| D600,016 | S | 9/2009 | Tiilikainen | |
| D600,021 | S | 9/2009 | Lindstrom | |
| D632,960 | S | 2/2011 | Gilfert | |
| 8,109,216 | B2 | 2/2012 | Nono et al. | |
| 8,235,214 | B2 | 8/2012 | Eiten et al. | |
| D667,305 | S | 9/2012 | Kuhn et al. | |
| 2002/0148837 | A1 * | 10/2002 | Apps | B65D 1/243 220/515 |
| 2005/0279651 | A1 | 12/2005 | Perret et al. | |
| 2006/0096942 | A1 | 5/2006 | Lane | |
| 2006/0260971 | A1 | 11/2006 | Rivera et al. | |
| 2006/0283755 | A1 | 12/2006 | Slat et al. | |
| 2008/0217200 | A1 | 9/2008 | Eiten et al. | |
| 2008/0302691 | A1 | 12/2008 | Olson et al. | |
| 2009/0108002 | A1 | 4/2009 | Delbrouck | |
| 2009/0223854 | A1 * | 9/2009 | Apps | 206/509 |
| 2010/0108544 | A1 | 5/2010 | Biundo | |
| 2010/0206759 | A1 | 8/2010 | Eiten et al. | |
| 2010/0213095 | A1 * | 8/2010 | Eiten | 206/509 |
| 2010/0326872 | A1 * | 12/2010 | Rivera et al. | 206/509 |
| 2011/0024318 | A1 * | 2/2011 | Gilfert | 206/433 |
| 2011/0284411 | A1 | 11/2011 | Delbrouck et al. | |
| 2013/0087477 | A1 | 4/2013 | Kuhn et al. | |
| 2013/0233815 | A1 | 9/2013 | Lesbirel | |

FOREIGN PATENT DOCUMENTS

| | | | |
|---|---|---|---|
| CA | 1301091 | | 5/1992 |
| CA | 1312311 | | 1/1993 |
| CA | 1313643 | | 2/1993 |
| CA | 2019014 | | 7/1993 |
| CA | 1330315 | | 6/1994 |
| CA | 1332717 | | 10/1994 |
| CA | 1335583 | | 5/1995 |
| CA | 2084852 | | 3/1996 |
| CA | 2199971 | | 3/1996 |
| CA | 2050008 | | 5/1996 |
| CA | 2195137 | | 7/1997 |
| CA | 2019582 | | 11/1997 |
| CA | 2207531 | | 4/1998 |
| CA | 2242883 | | 3/1999 |
| CA | 2126179 | | 8/1999 |
| CA | 2346126 | A1 | 5/2000 |
| CA | 2368713 | A1 | 11/2000 |
| CA | 2396000 | A1 | 12/2000 |
| CA | 2088008 | | 4/2001 |
| CA | 2212083 | C | 10/2001 |
| CA | 2072137 | C | 4/2002 |
| CA | 2218138 | C | 5/2002 |
| CA | 2361121 | A1 | 5/2002 |
| CA | 2145752 | C | 4/2003 |
| CA | 2408869 | A1 | 4/2003 |
| CA | 103676 | | 5/2004 |
| CA | 104487 | | 9/2004 |
| CA | 2255699 | C | 10/2006 |
| CA | 2608661 | A1 | 12/2006 |
| CA | 2334326 | C | 1/2007 |
| CA | 2351909 | C | 2/2008 |
| CA | 2385881 | C | 5/2008 |
| CA | 2670323 | A1 | 5/2008 |
| CA | 2683012 | A1 | 12/2008 |
| CA | 2701030 | A1 | 4/2009 |
| CA | 2389010 | C | 6/2009 |
| CA | 2443082 | C | 6/2009 |
| CA | 2376290 | C | 8/2009 |
| CA | 2654672 | A1 | 8/2009 |
| CA | 2451233 | C | 9/2009 |
| CA | 130401 | | 12/2009 |
| CA | 2666087 | A1 | 12/2009 |
| CA | 2669586 | A1 | 12/2009 |
| CA | 2681682 | A1 | 4/2010 |
| CA | 2681686 | A1 | 4/2010 |
| CA | 2377480 | C | 7/2010 |
| CA | 2755127 | A1 | 9/2010 |
| CA | 2699144 | A1 | 10/2010 |
| CA | 2699804 | A1 | 10/2010 |
| CA | 2706290 | A1 | 12/2010 |
| CA | 2707995 | A1 | 12/2010 |
| CA | 2463041 | C | 2/2011 |
| CA | 2713166 | A1 | 3/2011 |
| CA | 2513041 | C | 8/2011 |
| CA | 2804852 | A1 | 1/2012 |
| CA | 2561135 | C | 7/2012 |
| CA | 2767549 | A1 | 8/2012 |
| DE | 8108411 | U1 | 9/1981 |
| DE | 9210033 | U1 | 10/1992 |
| DE | 4425569 | A1 | 1/1996 |
| DE | 102005029304 | A1 | 1/2007 |
| GB | 1097870 | | 1/1968 |
| GB | 2 220 196 | | 1/1990 |
| WO | 9741044 | A1 | 11/1997 |
| WO | 9901345 | A1 | 1/1999 |
| WO | 0058173 | A1 | 10/2000 |
| WO | 2010055204 | A1 | 5/2010 |
| WO | 2011054700 | A1 | 5/2011 |
| WO | 2011138788 | A1 | 11/2011 |
| WO | 2012037993 | A1 | 3/2012 |
| WO | 2013004248 | A1 | 1/2013 |
| WO | 2013116269 | A1 | 8/2013 |

OTHER PUBLICATIONS

Examiner's Report dated Oct. 14, 2014 in connection with Canadian Patent Application No. 2,837,801, 2 pages.

(56) References Cited

OTHER PUBLICATIONS

Examiner's Report dated May 26, 2014 in connection with Canadian Patent Application No. 2,837,801, 2 pages.

* cited by examiner

STACKABLE TRAYS FOR JUGS, STACKED ARRANGEMENTS AND STACKING METHODS

CROSS-REFERENCE TO RELATED APPLICATIONS

This application claims the benefit of U.S. provisional patent application Ser. No. 61/751,377, filed on Jan. 11, 2013, and U.S. provisional patent application Ser. No. 61/787,960, filed Mar. 15, 2013, and U.S. provisional patent application Ser. No. 61/892,630, filed on Oct. 18, 2013, the entire contents of each of which are hereby incorporated herein by reference.

FIELD OF THE INVENTION

Embodiments of the invention relate to stackable trays for jugs typically containing liquids, such as milk, juice or water, and to stacked arrangements and stacking methods using such trays.

BACKGROUND

Beverages such as milk, juice and water, and/or other liquids, may be sold in jugs which are typically made of plastic. Jugs are typically filled with such beverages, for example, at a production location and then placed into crates and/or onto shelving units for shipping to a retail or wholesale location.

Crates for holding jugs may be made of plastic and are generally square or rectangular in shape. When such crates are stacked, one crate sits on the upper edges of the side walls of the crate below. Thus, each side wall supports a load from the crate(s) stacked above.

Jugs may also be arranged on a shelving unit which is typically constructed of metal, and consists of a frame and one or more shelves connected to the frame. The frame, generally, may include four vertical legs, which allow each shelf to be attached to the legs at each corner of the shelf. Wheels can be connected to a bottom side of a bottom shelf to provide mobility. Jugs can be placed on shelves for display and sale to a consumer. Each metal shelf, except the lowest shelf, may be folded up so that a shelf underneath can be loaded. The shelves are kept in the up position by means of a pull pin. The pull pin can unintentionally slide out of its guide allowing the shelf to fall from the up position.

SUMMARY

This summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments of the present disclosure provide for stacking jugs which typically, but not necessarily, contain beverages, such as milk, juice or water.

A stackable tray includes: a first surface to support a bottom of one or more jugs; a plurality of load transfer structures extending from a second surface opposite the first surface, to engage a plurality of jugs arranged below the second surface and transfer at least a portion of a load on the first surface to handles of the plurality of jugs.

Each of the load transfer structures has a substantially annular shape to surround a cap of a respective one of the plurality of jugs, in an embodiment.

The load transfer structures could include load transfer structures which have at least one channel to engage the handles of the plurality of jugs.

In some embodiments, the load transfer structures include load transfer structures that provide multiple channels to engage the handles of the plurality of jugs in different orientations of the jugs.

The load transfer structures could include load transfer structures which have one or more reinforcement ribs to strengthen the load transfer structures.

The stackable tray could include at least one support column extending from the first surface.

The load transfer structures could include load transfer surfaces which have a shape that is complementary to a shape of a shoulder portion of the plurality of jugs.

In some embodiments, the load transfer structures include load transfer structures to engage caps of the plurality of jugs.

The stackable tray could also include walls extending from the first surface, the walls defining jug receiving cells to receive bottom portions of a second plurality of jugs.

The load transfer structures could be adapted to nest at least partially in the jug receiving cells of another stackable tray when the jug receiving cells of the other stackable tray are empty.

In some embodiments, the jug receiving cells have at least one interior dimension that is larger than a complementary exterior dimension of the bottom portions of the second plurality of jugs.

The walls could include channels to receive reinforcement ribs in the bottom portions of the second plurality of jugs.

A stacked arrangement is also provided, and includes: multiple layers of jugs, each comprising a plurality of jugs; a respective stackable tray as described above, between adjacent layers of the multiple layers.

A method includes: providing a plurality of jugs; providing a plurality of the stackable trays described above; arranging the plurality of jugs in multiple layers, with a respective one of the plurality of stackable trays between adjacent layers of the multiple layers.

According to another aspect, a stacked arrangement includes: a stackable tray that includes a first surface to support a bottom of one or more jugs and a plurality of load transfer structures extending from a second surface opposite the first surface, to engage a plurality of jugs arranged below the second surface and transfer at least a portion of a load on the first surface to handles of the plurality of jugs; one or more jugs on the first surface; a plurality of jugs below the second surface.

Such a stacked arrangement could be sized for display in a retail setting.

The stacked arrangement could include a plurality of layers of jugs, including a first layer including the one or more jugs, a second layer including the plurality of jugs, and at least one further layer each including a further plurality of jugs, the stacked arrangement further including a respective further tray between each further layer of jugs and another layer of jugs.

In some embodiments, the stackable trays are adapted to at least partially nest when the trays are empty.

Each of the load transfer structures could have a substantially annular shape to surround a cap of a respective one of the plurality of jugs.

The load transfer structures could include load transfer structures which have at least one channel to engage the handles of the plurality of jugs.

The load transfer structures, in some embodiments, include load transfer structures that provide multiple channels to engage the handles of the plurality of jugs in different orientations of the jugs.

The load transfer structures could include load transfer structures which have one or more reinforcement ribs to strengthen the load transfer structures.

The stackable tray could include at least one support column extending from the first surface.

The load transfer structures could include load transfer surfaces which have a shape that is complementary to a shape of a shoulder portion of the plurality of jugs.

In some embodiments, the load transfer structures include load transfer structures to engage caps of the plurality of jugs.

The stackable tray could include walls extending from the first surface, the walls defining jug receiving cells to receive bottom portions of a second plurality of jugs comprising the one or more jugs.

The load transfer structures could be adapted to nest at least partially in the jug receiving cells of another stackable tray when the jug receiving cells of the other stackable tray are empty.

The jug receiving cells could have at least one interior dimension that is larger than a complementary exterior dimension of the bottom portions of the second plurality of jugs.

The walls could include channels to receive reinforcement ribs in the bottom portions of the second plurality of jugs.

A method includes: providing a stackable tray including a first surface to support a bottom of one or more jugs and a plurality of load transfer structures extending from a second surface opposite the first surface, to engage a plurality of jugs arranged below the second surface and transfer at least a portion of a load on the first surface to handles of the plurality of jugs; providing a plurality of jugs; stacking the plurality of jugs in multiple layers using the stackable tray.

In such a method, the stacking could involve stacking the plurality of jugs in three or four layers.

The stackable tray could be adapted to nest at least partially with another stackable tray when the trays are empty.

A stackable tray for jugs includes: a top surface having a plurality of jug receiving cells; a bottom surface having a plurality of collars extending downwardly therefrom, each collar having at least one notch sized to receive a portion of a handle of a respective jug located beneath each jug receiving cell.

In some embodiments, each collar has four notches, with each notch being sized to receive a portion of a handle of the jug, the four notches being placed at equidistant locations around the collar.

Each jug receiving could include a rib indent.

Each jug receiving cell could also include a raised portion on a bottom surface thereof.

In some embodiments, each collar has a recessed portion of substantially annular shape for surrounding a cap of the jug.

Each jug receiving cell could have at least one base support column extending from the top surface.

Each collar could be adapted to nest at least partially in a respective cell of another stackable tray when the jug receiving cells of the other stackable tray are empty.

A stacked arrangement includes: multiple layers of jugs, each comprising a plurality of jugs; a respective stackable tray as described above, between adjacent layers of the multiple layers.

A method includes: providing a plurality of jugs; providing a plurality of the stackable trays described above; arranging the plurality of jugs in multiple layers, with a respective one of the plurality of stackable trays between adjacent layers of the multiple layers.

A stacked arrangement includes: a plurality of stackable trays that each include a top surface having a plurality of jug receiving cells; a bottom surface having a plurality of collars extending downwardly therefrom, each collar having at least one notch sized to receive a portion of a handle of a respective jug located beneath each jug receiving cell; one or more jugs respectively positioned in one or more of the jug receiving cells; a plurality of jugs below the bottom surface and engaging the collars.

Such a stacked arrangement could also include a bottom-most tray below a bottom-most layer of jugs of the stacked arrangement, the bottom-most tray comprising a top surface having a plurality of jug receiving cells and a bottom surface which is free of collars.

In some embodiments, each collar has four notches, with each notch sized to receive the portion of the handle of the respective jug, the four notches being placed at equidistant locations around the collar.

The stacked arrangement could be sized for display in a retail setting.

The stacked arrangement could include a plurality of layers of jugs, the plurality of layers of jugs including a first layer including the one or more jugs, a second layer including the plurality of jugs, and at least one further layer each including a further plurality of jugs, the stacked arrangement further including a respective further tray between each further layer of jugs and another layer of jugs.

The stackable trays could be adapted to at least partially nest when the jug receiving cells of the trays are empty.

Each collar could have a recessed portion of substantially annular shape for surrounding a cap of a respective one of the plurality of jugs.

A method includes: providing a stackable tray that includes a top surface having a plurality of jug receiving cells and a bottom surface having a plurality of collars extending downwardly therefrom, each collar having at least one notch sized to receive a portion of a handle of a respective jug located beneath each jug receiving cell; providing a plurality of jugs; stacking the plurality of jugs using the stackable tray.

The stacking could involve stacking the plurality of jugs in three or four layers.

The stackable tray could be adapted to nest at least partially with another stackable tray when the trays are empty.

BRIEF DESCRIPTION OF THE DRAWINGS

In the following figures, dimensions of components are chosen for convenience and clarity only and are not necessarily shown to scale. Embodiments of the invention will now be described in greater detail with reference to the accompanying figures, in which.

DETAILED DESCRIPTION

Figure 1:
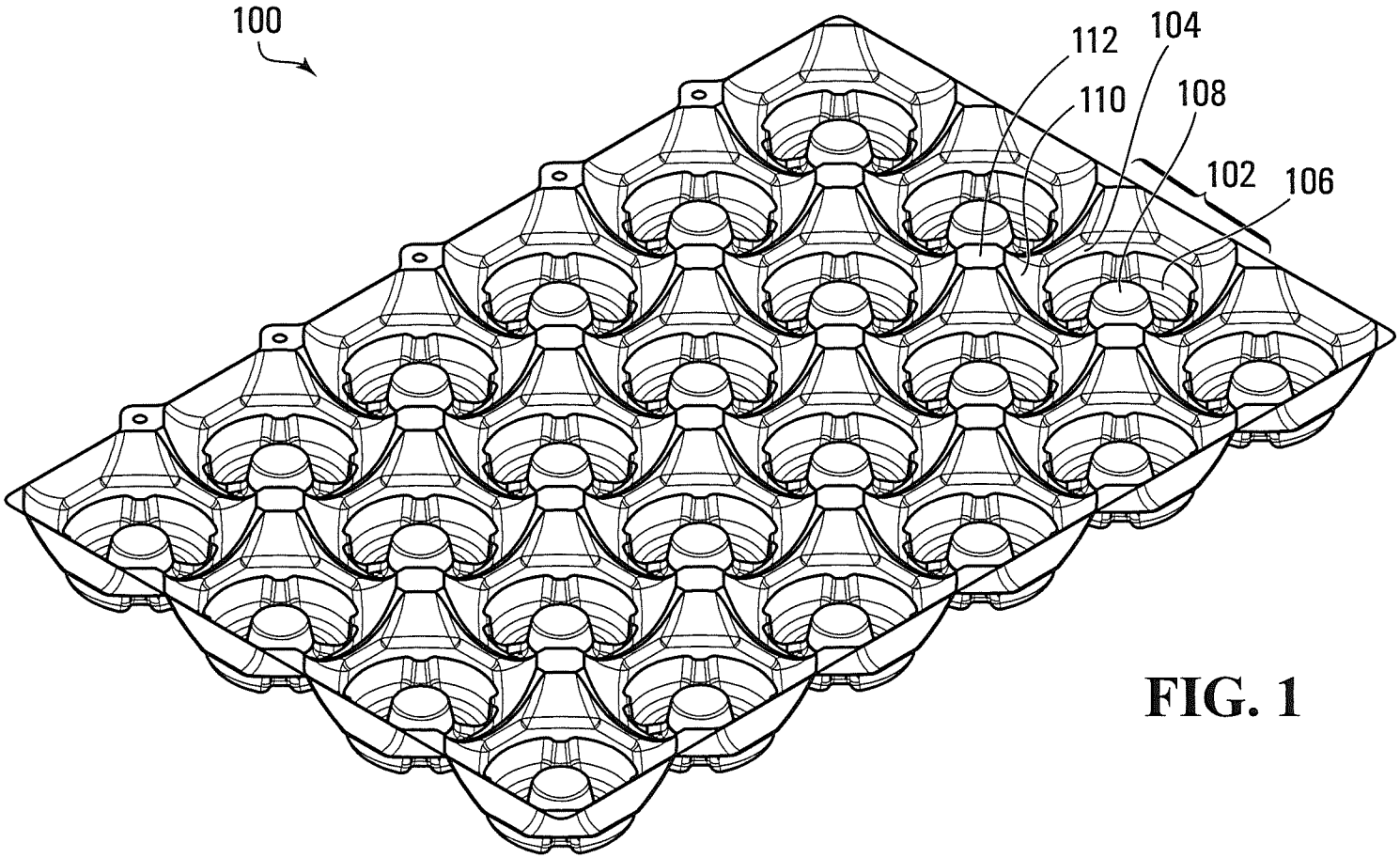
FIG. 1 is a perspective view of a tray for jugs according to a first embodiment.

Various embodiments illustrate trays for stacking, transporting, and displaying jugs. As used herein, the term "milk jugs" refers to jugs, typically made of plastic, that hold milk. Though the following description makes frequent reference to "milk jugs" in connection with one or more embodiments, it should be appreciated that embodiments could also or instead be used in association with stacking jugs or other suitable vessels containing other beverages, such as juice, water, and/or other liquids.

FIGS. 1 to 8 illustrate features of a stackable tray for jugs according to one embodiment. It should be appreciated that the embodiment shown in FIGS. 1 to 8 is intended solely for illustrative purposes, and that the present invention is in no way limited to the particular example embodiment explicitly shown in the drawings and described herein.

Referring to FIG. 1, the example tray 100 has a top side or surface to support a bottom of one or more jugs. In the example shown, the tray 100 comprises jug receiving cells 102 which are contoured for receiving the base of a jug so that the jug may rest upright as shown for the jug 300 in FIG. 5. The jugs could be custom jugs or standardized jugs. The jugs could be large, multi-serving beverage containers, for example 500 mL, 1 L, 2 L or 4 L plastic milk jugs. The base of the jug 300 could have any cross-sectional shape e.g. square, round, oval etc., and the cells 102 could then have the corresponding or complementary shape, e.g. square, round, oval etc. so each cell 102 and the base of the jug 300 correspond. Tray 100 can be configured and dimensioned differently to accommodate different shaped jugs 300 and/or a different number of jugs 300 than shown.

As shown in FIG. 1, the tray 100 may comprise an array of jug receiving cells 102. Each cell 102 may comprise a seat 104 along the perimeter of the cell 102 and a recess 106 which is surrounded by the seat 104. The cell 102 may also comprise a center portion 108. In the embodiment shown, the center portion 108 is flat and co-planar with the seat 104. The recess 106 may be annularly arranged around the center portion 108, between the center portion 108 and the seat 104. When the cell 102 receives the base of the jug 300, the base of the jug 300 may rest on seat 104 and the center portion 108 as seen in particular in FIG. 5. In another embodiment, cell 102 does not include recess 106. Thus, center portion 108 and seat 104 may form a single, flat surface and the base of the jug 300 may rest on the single surface comprising center portion 108 and seat 104.

The tray 100 may further comprise one or more base support columns 110 which may be arranged outwards from the center of the seat 104 and surrounding the seat 104. The base support columns 110 may extend upwards from the tray 100. The base support columns 110 may slant upwards from the seat 104. The base support columns 110 may also have a varying shape and/or cross-section as they extend upwards from the tray 100. The base support columns 110 are also shaped to conform to the base of the jug 300. Thus, when the cell 102 receives the base of the jug 300 and when the base of the jug 300 rests on the seat 104, the base support columns 110 may engage a portion of the side wall of the jug 300 at or near where the side walls of the jug 300 meet the base of the jug 300. Thus, the base support columns 110 may provide additional support to the side walls and base of the jug 300 and may aid to define the cell 102. The base support columns 110 may culminate in a distal or top surface 112. The surface 112 may be flat or may have a different contour or surface shape.

The base support columns 110 may aid in preventing the jug 300 from tipping over, may aid in orienting the jug 300 as desired and/or may provide lateral support to prevent lateral shifting of the jugs 300. The base support columns 110 may also aid in supporting the sidewalls of the jugs 300 if they deform, and/or aid in preventing jug deformation, under the load during stacking the jugs 300 using the trays 100 in vertical plurality.

Figure 2:
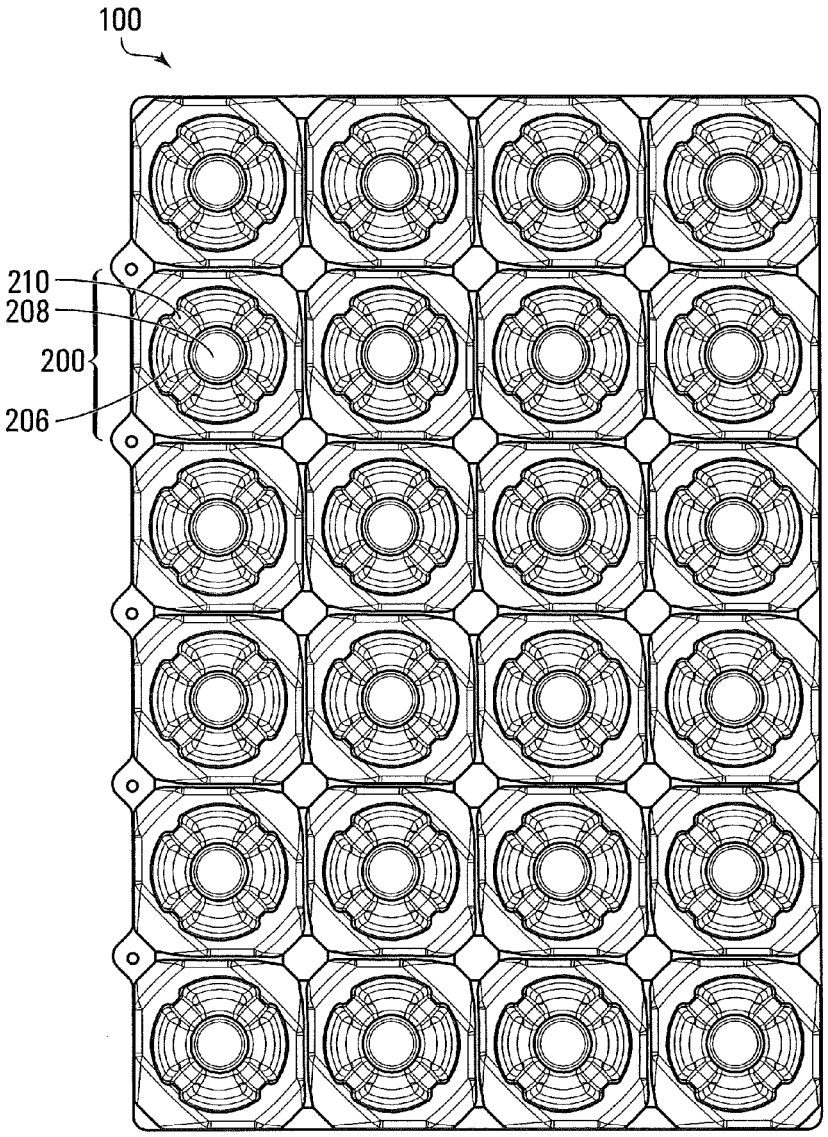
FIG. 2 is a bottom view of the tray of FIG. 1.
Figure 3:
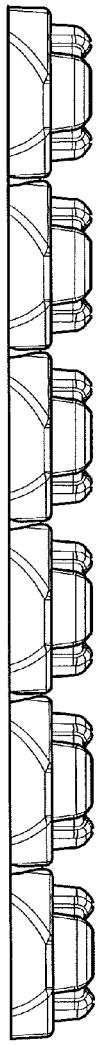
FIGS. 3 and 4 are plan views of the tray of FIG. 1.
Figure 4:
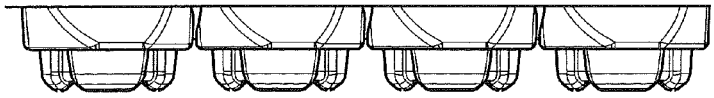
Figure 5:
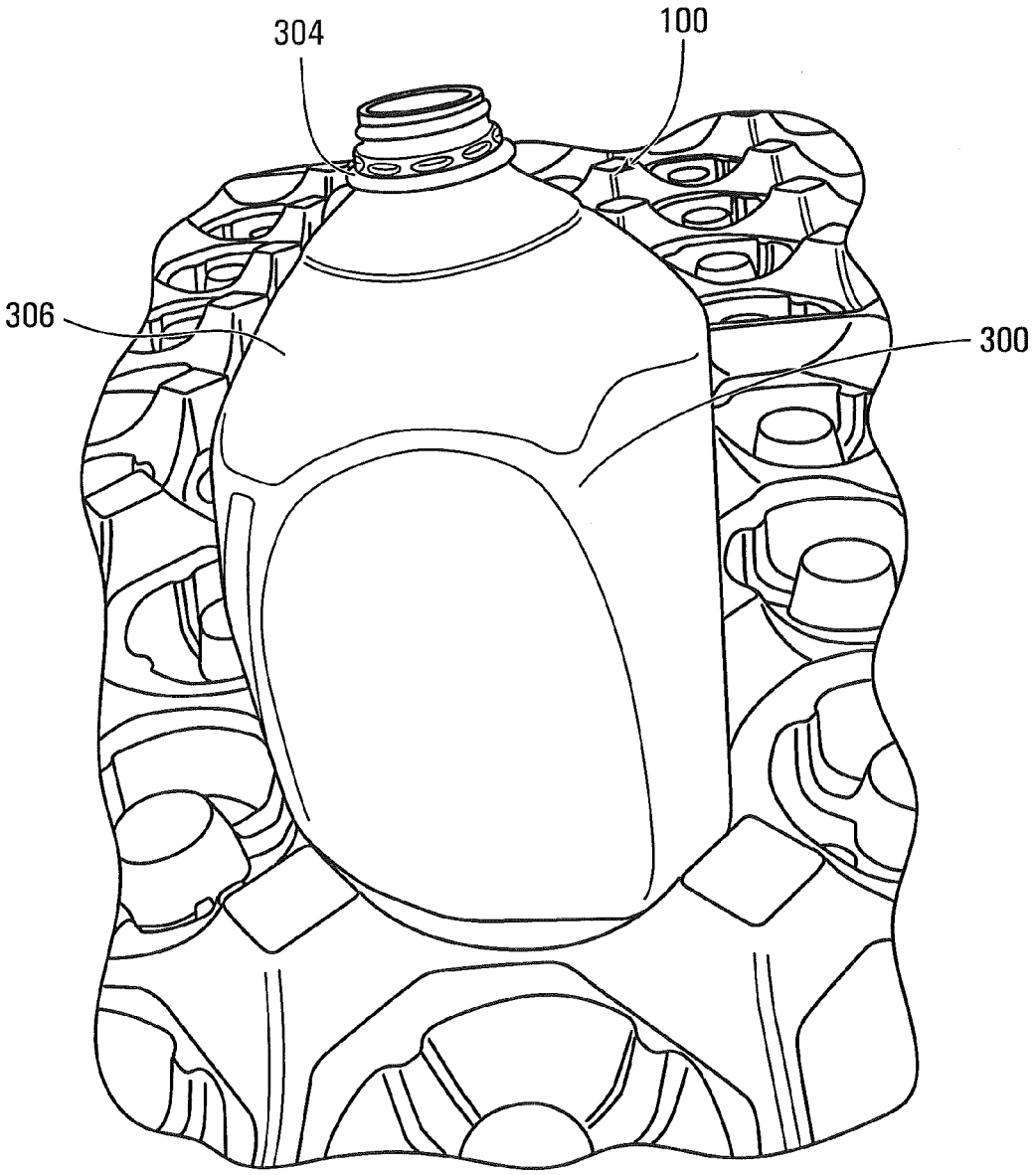
FIG. 5 is a photograph of a jug resting on the tray of FIG. 1.

As shown perhaps most clearly in FIGS. 2 to 4, an underside of the tray 100 comprises collars 200 in one embodiment. Each collar 200 comprises a protruding portion 206 arranged around a recessed center portion 208. Each collar 200 is located on the underside of a respective cell 102. Therefore, if the tray 100 comprises an array of cells 102 as shown in the embodiment of FIG. 1, an array of collars 200 may be found on the underside of the tray 100 as shown in FIG. 2, each collar 200 corresponding to a respective cell 102. In other embodiments, collars could be provided on the underside or bottom surface of a tray without necessarily providing separate jug receiving cells on the top surface opposite each collar.

Figure 6:
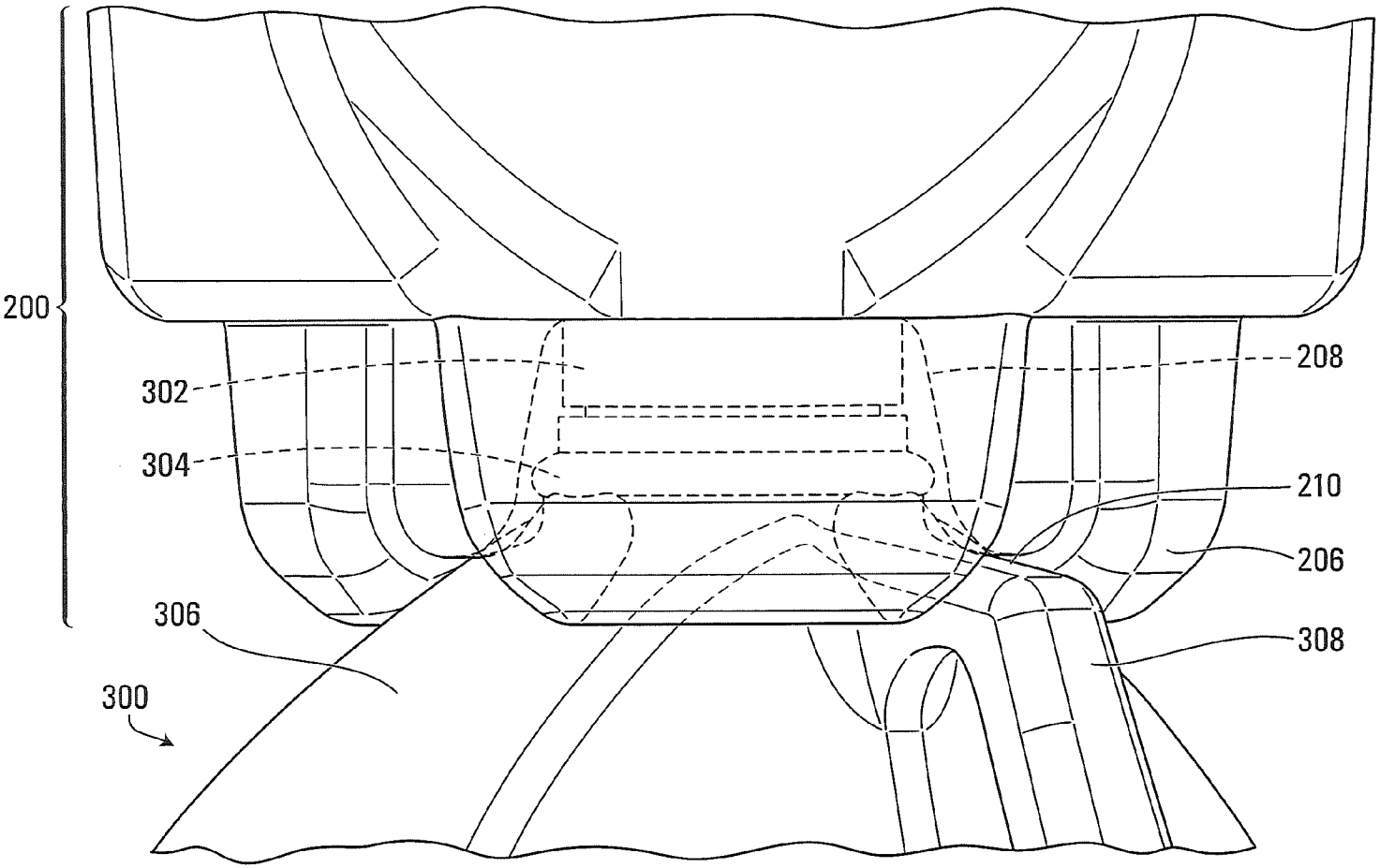
FIG. 6 is a close-up representation of how an underside of the tray of FIG. 1 fits onto a top of a jug.
Figure 7:
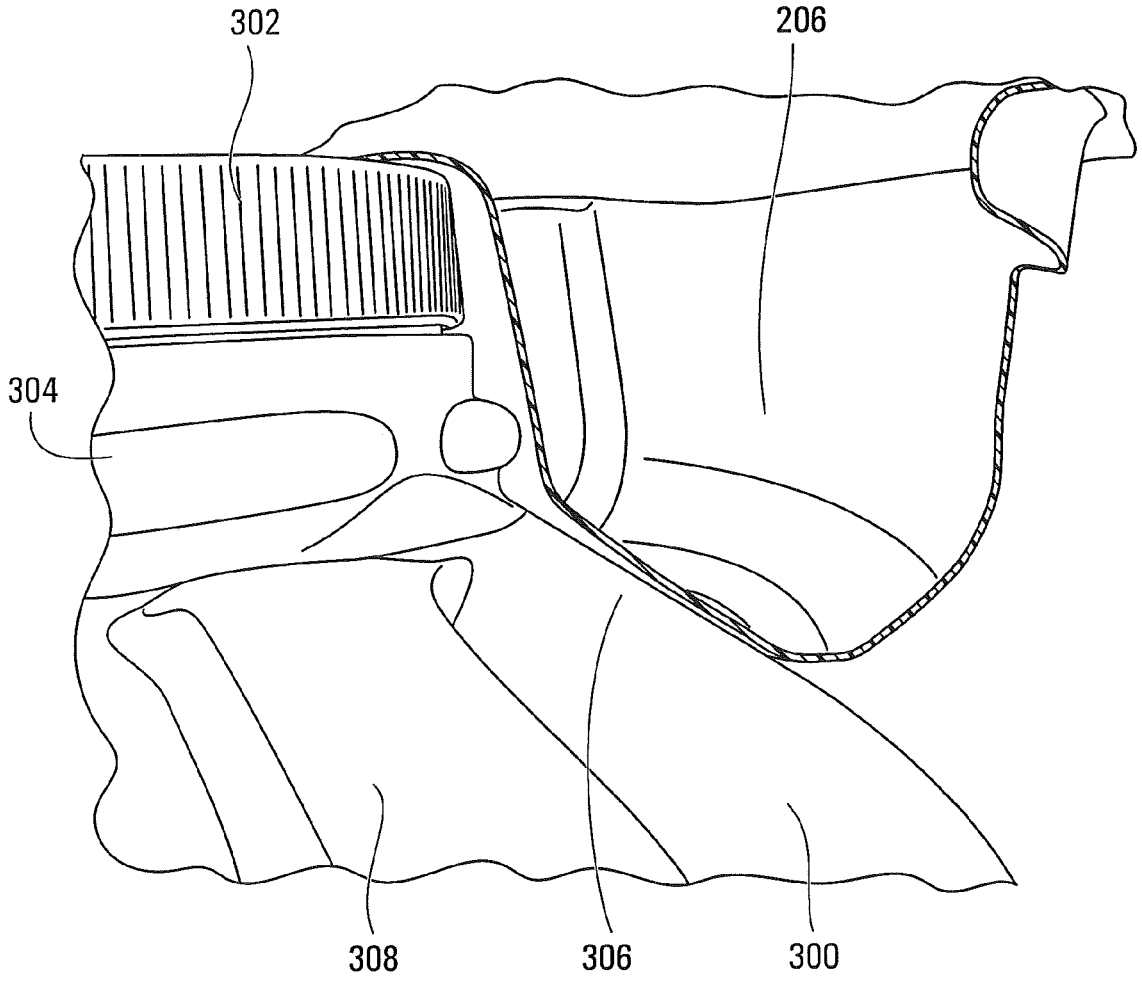
FIG. 7 is a close-up photograph of how an underside of the tray of FIG. 1 fits onto a shoulder of a jug, the underside being cross-sectioned.
Figure 8:
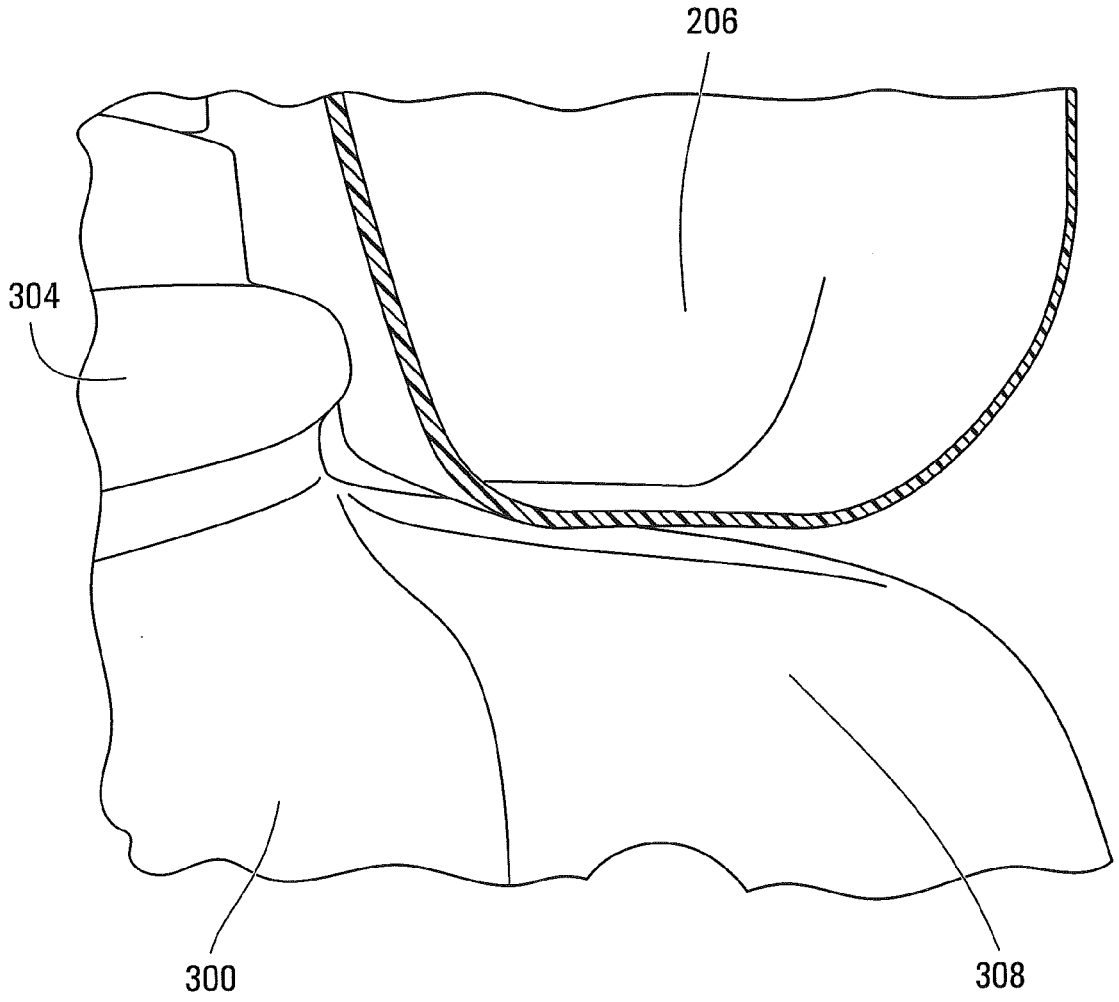
FIG. 8 is a close-up photograph of how an underside of the tray of FIG. 1 fits onto a handle of a jug, the underside being cross-sectioned.

Referring to FIGS. 6 to 8, the collar 200 extends downwardly from the underside of the tray 100 and is shaped to receive and engage a top of the jug 300, including, but not limited to, a cap 302, neck 304, shoulder 306 and/or handle 308 of the jug 300. The protruding portion 206 may be shaped to surround the cap 302 of the jug. The protruding portion 206 may be configured to rest on at least a portion of the top of the jug 300 including at least the shoulder 306 of the jug 300. The protruding portion 206 may be shaped as an annulus or ring which surrounds the cap 302 and matches the shape of the top of the jug 300 in order to rest on the neck 304, shoulder 306, and/or handle 308 of the jug 300 creating a contact surface area between the collar 200 and the top of the jug 300. The contact surface area is not necessarily contiguous and may comprise an area of contact at the cap 302, neck 304, shoulder 306 and/or handle 308 of the jug 300. The top of the jug 300 may have a variety of cross-sections e.g. square, round, oval etc. or other, non-symmetrical shapes. Thus, the collar 200 may also have various cross-sections corresponding to the top of the jug 300. The protruding portion 206 may take on any shape in order to better match the shape of the top of the jug 300.

The protruding portion 206 may further comprise one or more channels or notches 210. The channel 210 may be arranged in the protruding portion 206 and may be contoured to receive the handle 308 of the jug 300. The jug 300 may have only one handle 308, while the protruding portion 206 may have more than one channel 210, where one channel 210 receives the handle 308 and the other channels 210 do not receive anything, depending on the orientation of the jug 300. In another embodiment, the jug 300 may have a plurality of handles 308 in which case the protruding portion 206 may include a matching plurality of channels 210 to correspond with the plurality of handles 308. In the embodiment shown, each collar 200 has four channels 210, placed at equidistant locations around the collar. There could be more or fewer channels in other embodiments.

The shape of the collar 200 may be configured to adjust the desired contact surface area between the collar 200 and the top of the jug 300, in order to aid stacking of the jugs 300 using the trays 100. A desired contact surface area may depend on the embodiment of the tray 100 and/or the jug 300 being used. The desired contact surface area may be based in part or entirely on the desired weight distribution onto a jug 300 when the jugs 300 are stacked using the trays 100. In one embodiment, it may be desirable to augment the contact area between the collar 200 and the top of the jug 300 to reduce the weight per unit of contact surface area. It may also be desirable to evenly distribute the weight over the top of the jug 300. In yet another embodiment, it may be desirable to distribute more weight to at least one specific part of the jug 300, for instance the neck 304, shoulder 306 or handle 308.

As shown in FIGS. 6 to 8, the center portion 208 may be contoured or shaped to receive the cap or lid 302 of the jug 300. The center portion 208 may have a flat inner surface that is coplanar with and rests on the cap 302. In another embodiment, the cap 302 might not be flat and the contour of the center portion 208 could match the contour or shape of the cap 302.

The collar 200 and cell 102 may be contoured to engage the shape of the jug 300 and are not necessarily symmetrical in any or all planes.

In one embodiment, the entire tray 100 may be created as a single unit of material. Means of creating the tray 100 out of a single unit of material may allow one to save material and therefore may reduce manufacturing costs. The tray 100 may be made by any of a variety of methods, for instance thermoforming, injection molding, compression molding or rotational molding, among others. The tray 100 could be made out of any suitable material that is sufficiently rigid e.g. polymers such as high-density polyethylene, high-molecular weight polyethylene, polystyrene, metals such as aluminum or steel, composite materials such as polymers combined with cellulose (paper) or other fibers, other suitable composites, or a combination of a polymer and a metal. The tray 100 might instead be made of two or more separate pieces that have been releasably or permanently connected or joined by a variety of methods e.g. welding, using fasteners, gluing etc. Similarly, the tray 100 could be reinforced during manufacturing or after being manufactured. The tray 100 could be reinforced with a combination of various materials which are sufficiently suitable for the purpose of reinforcement.

Where the tray 100 is thermo-formed from a single unit of material, the underside of the tray will be the reverse or mirror image of the topside of the tray 100. Thus, collar 200 is formed as the underside of cell 102, protruding portion 206 is formed as the underside of recess 106 and the center portion 208 is formed as the underside of center portion 108.

As shown in FIG. 2, the one or more channels 210 may be arranged in such a manner that when the one or more channels 210 receive at least a portion of the handle 308 of the jug 300, with the jug 300 oriented in a particular direction. Thus, when an array of collars 200 is provided, each jug 300 may be oriented in the same direction, which may aid in displaying the jugs 300 for sale. This type of jug orientation feature of the channels 210 could be provided without having the channels actually transfer load to the handles 308. Sides of the channels 210 could contact sides of the handles 308 to provide this orientation feature without necessarily transferring load onto the handles. The collars 200 and channels 210 could be sized and/or shaped to provide clearance between handle top surfaces and channel top surfaces, instead of having those surfaces in contact as shown in FIG. 8, for example.

In yet another embodiment, the cells 102 and/or channels 210 may be oriented in such a way as to match the orientation of the base of the jugs 300 or the handle 308 of the jugs 300, respectively, as they exit a production line after being filled with liquid. Thus, less manual or robotic labour may be needed to place the jugs 300 onto the trays 100.

Cells 102 may be arranged to form an array of cells. The cells 102 may be arranged in an array of four by six, however other arrays of cells 102 are possible. The tray 100 may be configured in a continuous array, where each cell 102 is connected to its neighbouring cells 102. The tray 100 may be configured and dimensioned in various sizes and with various numbers of cells 102, e.g. six by four, six by six, etc. The tray 100 may be configured to have a width and a length sufficiently large to fit onto a standard pallet of 40 inches by 48 inches or any other desired pallet. In another embodiment, tray 100 may be adapted at one or more edges of the tray to be joined together laterally with a second tray 100. Thus, for instance, two trays 100, each having an array of six by four cells, may be joined to form an array of six by eight cells. The trays 100 may be joined using a variety of joining means including welding. Multiple trays could be used between layers in a stacked arrangement without necessarily joining the trays to each other. For example, two trays having a 4-by-3 array of cells could be used between layers of jugs that include arrays of 4 jugs by 6 jugs. Joining the trays could increase stability of the stacked arrangement, but trays need not necessarily be joined together in all embodiment.

When an array of cells 102 is arranged as shown in FIGS. 1 to 5, it is possible to place an array of jugs 300 on the tray 100, each jug 300 being placed in one cell 102. Thus, a layer of jugs 300 may be arranged on the tray 100.

Figure 9:
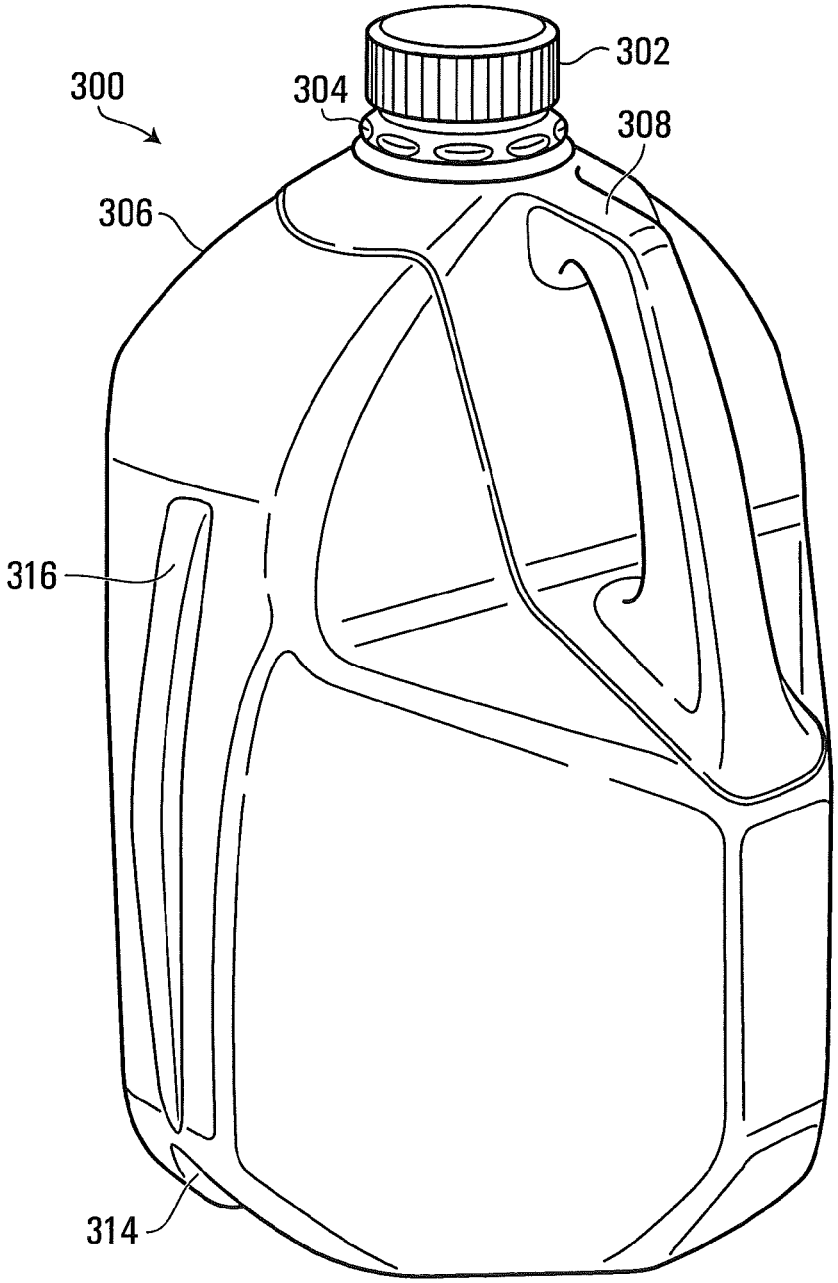
FIG. 9 is a side perspective view of an embodiment of an example jug.
Figure 10:
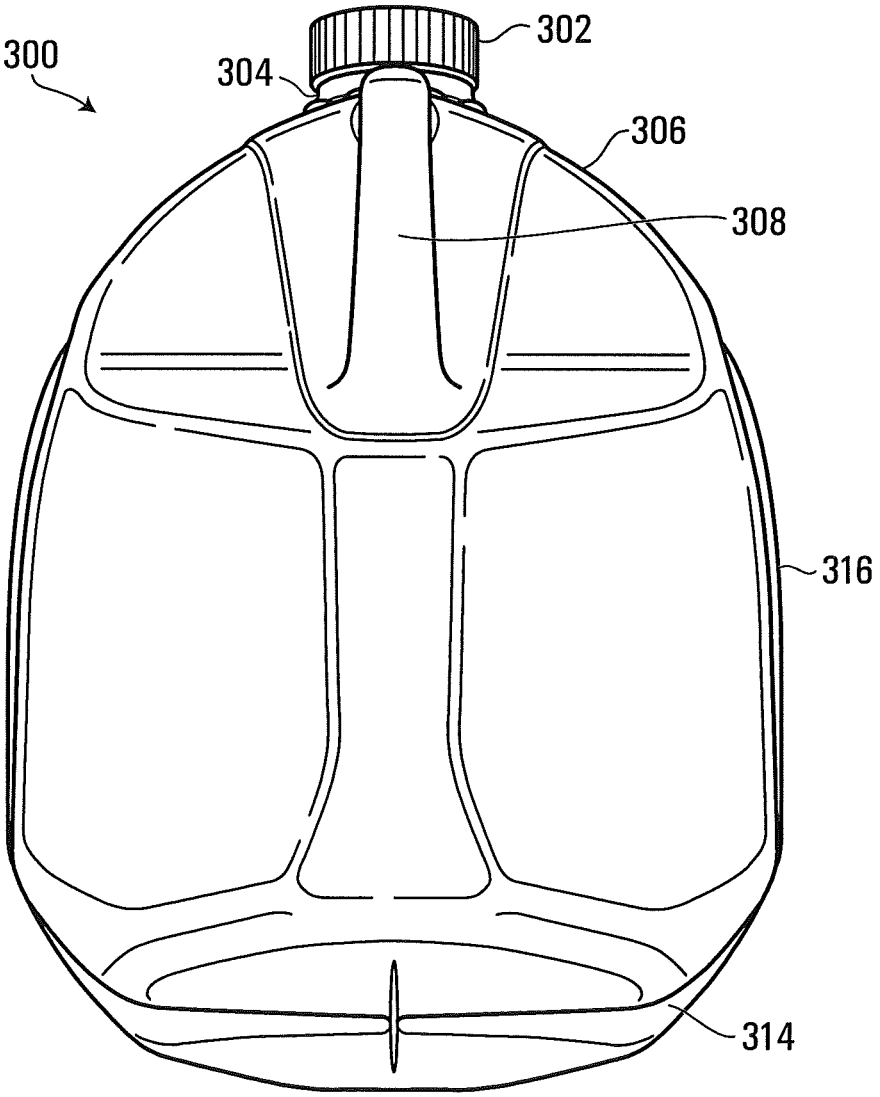
FIG. 10 is a lower perspective view of the jug of FIG. 9.

One embodiment of a jug 300 for use with the stackable tray of the present disclosure is shown in FIGS. 9 and 10. In the embodiment shown, jug 300 may comprise cap 302, neck 304, shoulder 306, handle 308, recess 314 and rib 316. Although jug 300 may comprise any desired number of ribs 316, in the embodiment shown, jug 300 comprises three: one at each corner of the jug 300 other than the corner along which the handle 308 is located in the example shown. The corner of the jug 300 where the handle 308 is located does not include a rib 316 in the embodiment shown. Each rib 316 protrudes from a corner of the jug 300 and runs vertically along the corner. Ribs 316 may provide support and strength to the jug 300 when the jugs 300 are stacked. Although outward or protruding ribs are shown at 316, inward ribs or channels could also or instead be used to provide support an strength. Reinforcement ribs could be outward ribs as shown or inward ribs, also referred to herein as channels.

In the embodiment shown, recess 314 may extend diagonally along the bottom of the jug 300 from one corner to the diagonally opposing corner. In the embodiment shown, recess 314 is triangle-like in shape and narrows as it progresses towards the center of the bottom of the jug 300 from each direction.

Figure 11:
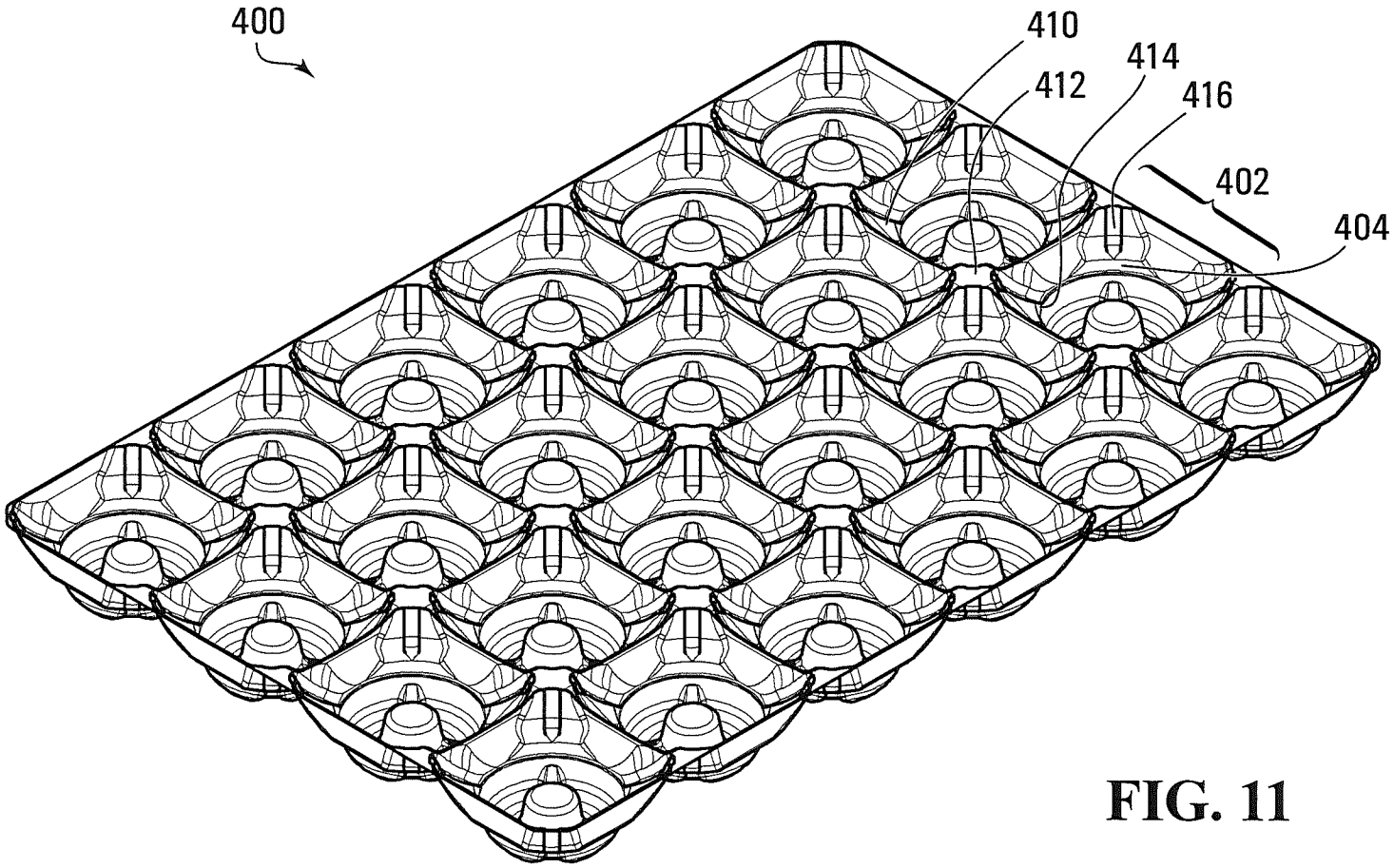
FIG. 11 is a perspective view of a tray for jugs according to a second embodiment.
Figure 12:
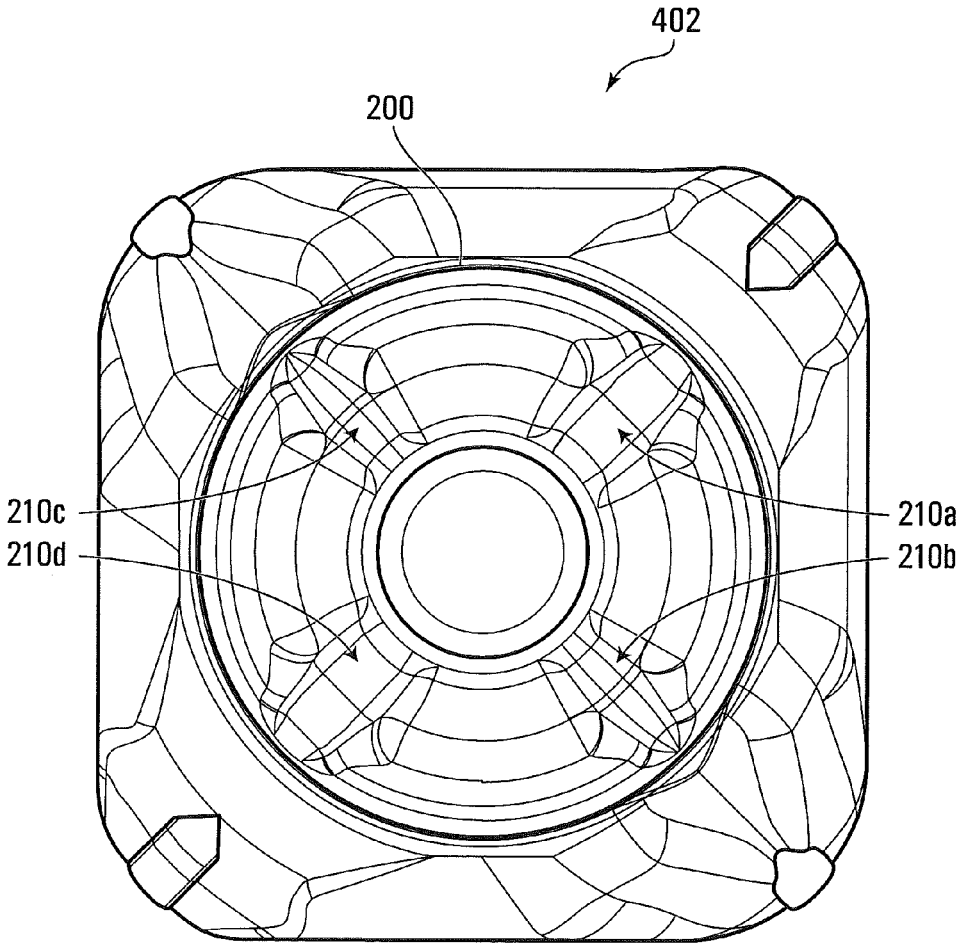
FIG. 12 is an enlarged bottom view of a portion of the tray of FIG. 11.

Another embodiment of a stackable tray is shown in FIGS. 11 and 12 and will be referred to using reference numeral 400. It will be understood that, where applicable, the discussion herein of stackable tray 100 also applies equally to stackable tray 400. It will also be understood that like features between the embodiments of stackable trays 100 and 400 will be given like reference numerals.

In the embodiment shown in FIGS. 11 and 12, channels 410 might not be all the same size. FIG. 12 shows an enlarged bottom view of a cell 402 of tray 400. Specifically, each collar 200 may comprise four channels 210*a*, 210*b*, 210*c* and 210*d*. Opposing channels 210*a* and 210*d* are of the same size and opposing channels 210*b* and 210*c* are of the same size. Opposing channels 210*a*, 210*d* are sized to receive the handle 308 of the jug 300, while the opposing channels 210*b*, 210*c* are too narrow to receive the handle 308. Thus, it will be appreciated that collar 200 may only be placed in one of two orientations onto the top of the jug 300. In the embodiment shown, the two orientations are 180 degrees apart.

Channels 210*a*, 210*b*, 210*c*, 210*d* may provide rigidity to the collar 200, which could be particularly useful when the jugs 300 are stacked using the tray 400. The channels 210 in the example tray 100 in FIGS. 1 to 4 may similarly provide rigidity to the collar 200.

As shown in FIG. 11, base support columns 410 may include rib indents 416. Rib indents 416 may extend vertically on the sides of base support columns 410, which face into the cell 402. Rib indents 416 are shaped to receive and mate with the ribs 316 on the exterior of the jug 300. Depending on the number and location of ribs 316 on the exterior of the jug 300, a corresponding number of rib indents 416 with corresponding locations may be included in the base support columns 410. Rib indents 416 may provide additional support to the jug 300 as it sits in cell 402. Rib indents 416 may also aid in providing a snug fit between the bottom of jug 300 and cell 402.

Tray 400 may further comprise raised portions 414. Raised portions 414 may be situated on seat 404 and mate with corresponding recess 314 in the bottom of the jug 300 when jug 300 is placed in the cell 402. Raised portions 414 may comprise a variety of shapes. In the embodiment shown in FIG. 11, raised portions 414 comprise triangle-like projections which correspond to portions of the recess 314 in the two opposed bottom corners of the jug 300 where recess 314 is located. It will be appreciated that only a portion of recess 314 mates with raised portions 414 as, in the embodiment shown, the raised portions 414 are only found on the seat 404.

In one embodiment, raised portions 414—and thus corresponding recess 314 on the bottom of the jug 300—are located such that jugs 300 can only fit into cells 402 in one of two orientations. Accordingly, the jug 300 may be placed into a cell 402 in either a first or a second orientation, the jug 300 being rotated 180 degrees about its vertical axis between the first and second orientations. Other configurations of raised portions 414 are possible to allow jugs 300 to fit in any desired orientation.

Thus, when jugs 300 are placed into cells 402, the orientation of the jug 300 should match the orientation of the raised portions 414 in order to ensure a proper placement of jug 300 into the cell 402. Furthermore, when the jugs 300 are stacked using trays 400, the orientation and positioning of the channels 210 will correlate with raised portions 414 on the tray 400 underneath so that the orientation determined by the raised portions 414 matches the orientation determined by the positioning of channels that are sized to receive a portion of the handle 308. This may aid in orienting the jugs 300 in a desired manner so that, for instance, the label on a portion of jug 300 is always visible to a customer when the jugs 300 are stacked for display.

Figure 13:
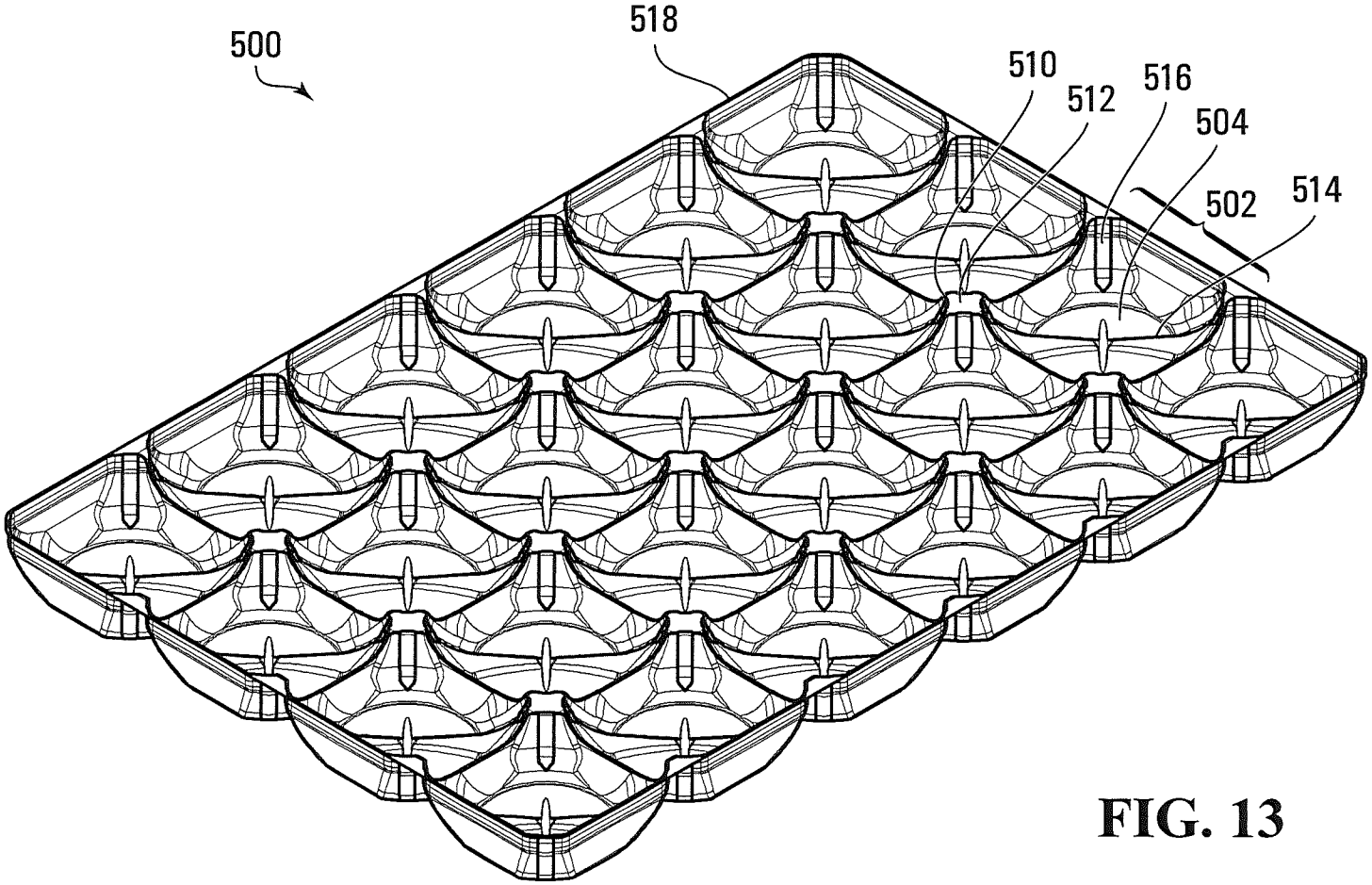
FIG. 13 is a perspective view of a tray for jugs according to a third embodiment.

Yet another embodiment of a stackable tray is shown in FIG. 13 and will be referred to using reference numeral 500. It will be understood that, where applicable, the discussion herein of stackable trays 100 and 400 also applies equally to stackable tray 500. It will also be understood that like features between the embodiments of stackable trays 100, 400 and 500 will be given like reference numerals.

In the embodiment shown in FIG. 13, similar to tray 400, tray 500 may comprise rib indents 516 and raised portions 514, which serve similar functions as in tray 400 and are designed to match corresponding features on jug 300, namely ribs 316 and recess 314, respectively.

In the embodiment shown, tray 500 may comprise a substantially flat bottom on the underside of each cell 502. Thus, tray 500 does not include a corresponding collar 200. As a result, the seat 504 of each cell 502 may be substantially flat except for raised portions 514. The substantially flat bottom of each cell 502 may better permit tray 500 to be placed on a flat surface, for example the ground or a pallet. Thus, the tray 500 may be suitable as the bottom-most tray when jugs 300 are stacked using trays 400 and 500. The substantially flat bottom of each cell 502 may provide additional stability when jugs 300 are stacked, transported and displayed as compared to when jugs 300 are stacked without the tray 500 being used as the bottom-most tray.

Tray 500 may comprise a raised perimeter 518. Raised perimeter 518 is comprised of the exterior walls of the cells 502, formed on the outer periphery of tray 500, and the base support columns 510, formed on the outer periphery of tray 500. Raised perimeter 518 extends horizontally around the entire outer periphery of tray 500 and extends vertically to a height greater than the height of the base support columns 510, formed in the interior of tray 500. The raised perimeter 518 may provide additional stability and support to the jugs 300 when jugs 300 are stacked using the trays 400 and 500. For instance, raised perimeter 518 could help to prevent deformation of jugs 300 in the bottom-most layer, as these jugs would be subject to the greatest load when the jugs 300 are stacked.

Figure 14:
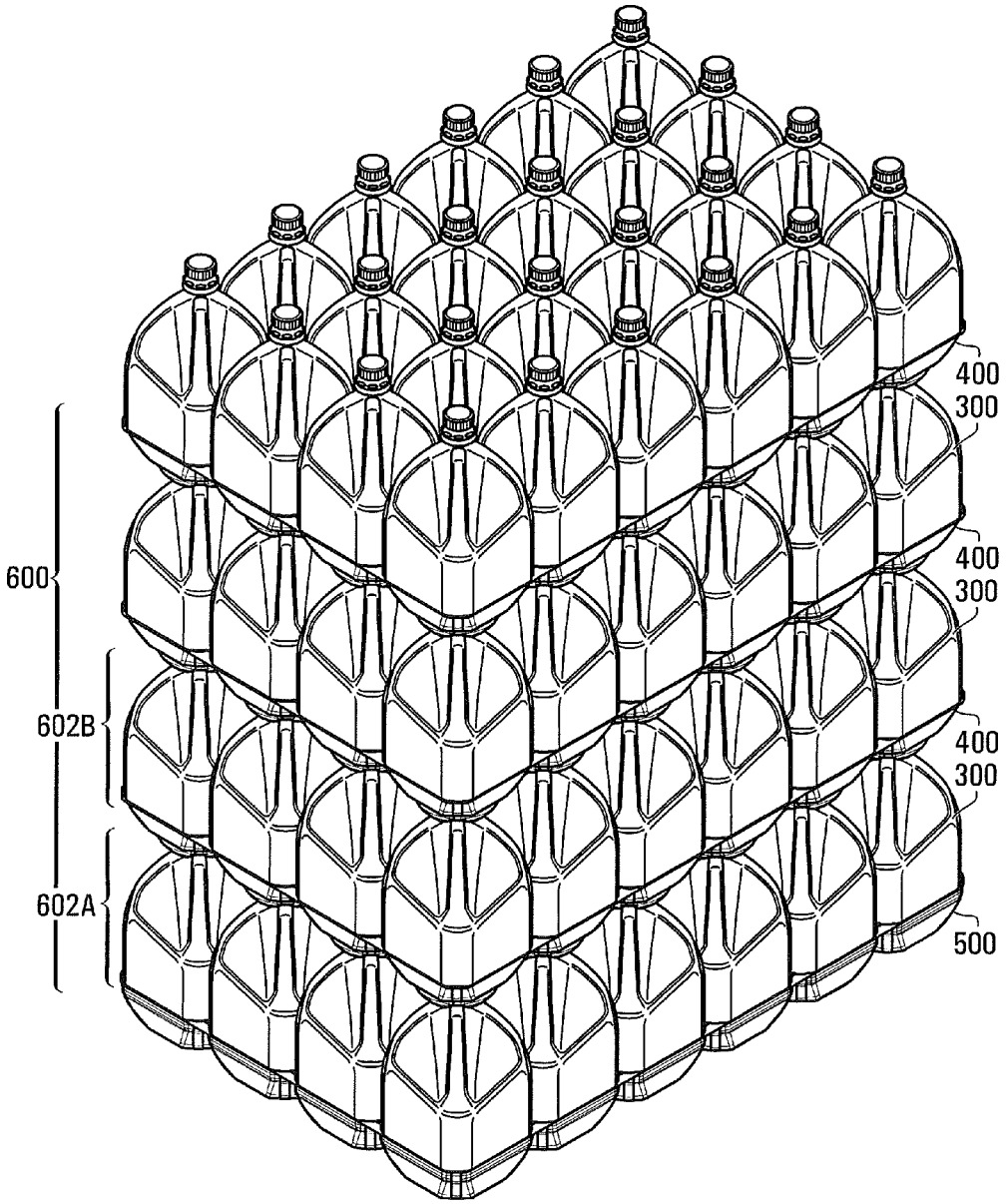
FIG. 14 is a perspective view of a stacked arrangement according to one embodiment.

An embodiment of a stacked arrangement 600 is shown in FIG. 14. In the embodiment shown, a first layer 602A of jugs 300 is arranged on a tray 500. However, it should be noted that the jugs 300 may be arranged on the floor or any other desired surface. When the jugs 300 are arranged, a tray 400 is then placed on top of the first layer 602A of the jugs 300. Each collar 200 of the tray 400 rests on the top of a jug 300 of the layer 602A underneath. A second layer 602B of jugs 300 may then in turn be arranged in the cells 402 of the tray 400. This may be repeated with yet a further tray 400 and a third layer of jugs 300 and so on. Thus, in such a stacked arrangement 600, the weight of each layer of jugs 300 is supported by the layer of jugs 300 underneath and so on. Thus, as one progresses down the stack, each jug 300 in each layer carries a portion of the load of the jugs 300 vertically above it. Although four layers are shown, there could be more or fewer layers in a stacked arrangement.

The shape of the collar 200 may be configured to adjust the desired contact surface area between the collar 200 and the top of the jug 300 underneath, in order to aid the stacking of the jugs 300 using trays 100. The desired contact surface area between the collar 200 and the top of the jug 300 may vary depending on the configuration of the tray and/or the jugs 300 being used. The desired contact surface area may be based in part or entirely on the desired weight distribution onto the jug 300. In one embodiment, it may be desirable to augment the contact area to reduce the weight per unit of contact surface area. It may also be desirable to evenly distribute the weight over the top of the jug 300. Distributing the weight evenly over the top of the jug 300 may include, but is not limited to, distributing the weight evenly over at least one of the cap 302, the neck 304, the shoulder 306 and the handle 308 of the jug 300. In yet another embodiment, it may be desirable to distribute more weight to at least one specific portion of the top of the jug 300, for instance a portion of the top of the jug 300, which is better suited to carrying a load. A portion of the top of the jug 300 may be better suited for carrying a load because of, for instance, that portion's rigidity or structural integrity. Similar considerations apply to every layer of jugs 300 in the stacking assembly 600.

One may stack a desired number of the jugs 300 using the trays 400 and 500, with the load of each jug 300 being supported by the jug 300 underneath it. The number of jugs 300 stacked using trays 400 and 500 may be limited by the structural integrity and load carrying capacity of the jugs 300, trays 400, 500 being used and the stability of the stacking assembly 600.

In another embodiment, the base support columns 410, 510 may extend up from the topside of the tray 400, 500 so that the distal surface 412, 512 engages the underside of the next tray 400 above. In one embodiment, base support columns 410, 510 may engage the underside of the tray 400 above or recesses formed on the underside of the tray 400 above with a positive fit (friction type locking feature). This may aid in securing the base support columns 410, 510 into place and/or may provide load column alignment and lateral support. The base support columns 410, 510 may engage the sides of the jug 300. The base support columns 410, 510 may aid in carrying at least a portion of the load of the jugs 300 and trays 400 above. The base support columns 410, 510 may also provide lateral support to prevent shifting and/or deformation of the jugs 300.

In some embodiments, the top layer of jugs 300 may or may not have a further tray 400 resting on top of it.

One or more stacked arrangements 600 may be assembled at a production location. The stacked arrangements 600 may be arranged on a pallet or other suitable means for transporting. As discussed above, the stacked arrangements 600 may have the bottom most layer of jugs 300 standing directly on a tray 500, which is in turn placed on a pallet or the means for transporting. The stacked arrangements 600 may be wrapped with plastic wrap and/or corner protections to provide stability during shipping. The stacked arrangements 600 may be placed on a pallet and then loaded onto a truck or other vehicle using a forklift, clamp truck or other means. Alternatively, the stacked arrangements 600 may be assembled, shipped, and/or displayed without a pallet. In one embodiment, the dimensions of the trays 400, 500 allow for an array of jugs 300 which fit onto and occupy a standard pallet used in the shipping, distribution packaging and transporting industry. However, in other embodiments the stacked arrangement 600 might not occupy an entire pallet. The stacked arrangement 600 might occupy any fraction of a pallet e.g. one half, one quarter, one third etc. The stacked arrangement 600 might also be distributed and transported using other means that might not involve a pallet, for example, a flat bed cart with wheels. Alternatively, in another embodiment, the lowest tray 500 could be provided with wheels in order to move the stacked arrangement 600.

One or more such stacked arrangements 600 could then be shipped to a retail or wholesale location. At the retail or wholesale location, using a forklift, clamp truck or other means, the stacked arrangement could then be placed in a position to provide access to customers. Customers may then take jugs 300 as necessary from the uppermost tray 400. When the tray 400 is empty, the tray 400 may be removed, exposing the layer of jugs 300 resting on the tray 400 or 500 beneath. In such a manner, it is possible to vend jugs 300 to customers without the need for manual or other kinds of labour to transfer the jugs 300 from the means used for shipping the jugs 300 to other means used for displaying and selling the jugs 300.

Figure 15:
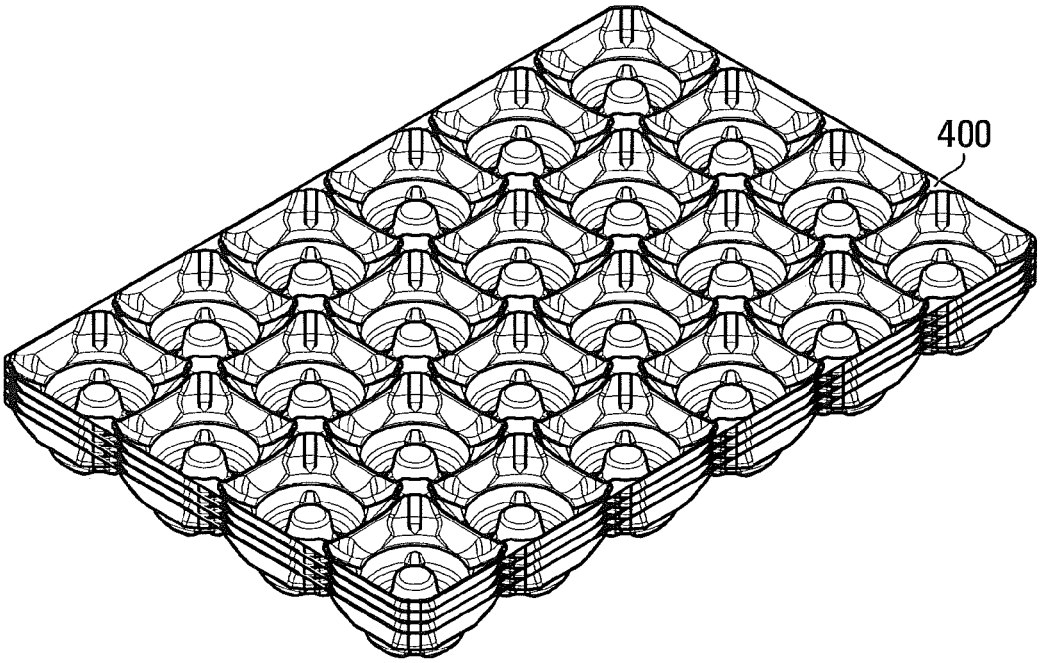
FIG. 15 is a perspective view of a stack of empty, nesting trays of FIG. 11.

In one embodiment, the underside of a first tray 400 may be contoured, shaped or configured to be able to nest, at least partially, into the top side of a second tray 400 i.e. so that a collar 200 is received by a corresponding cell 402. As can be seen in the embodiment of FIG. 15, in such a manner it is possible to nest the trays 400 so that when empty trays 400 are stacked, they take up less vertical space than a stacked arrangement loaded with jugs 300. Thus, when empty trays 400 are returned to the production location, there may be additional room in the shipping truck or vehicle to include other goods, which may save time and costs.

By distributing a portion of the load of the stacked arrangement 600 onto the jugs 300 being stacked, it is possible to reduce or substantially eliminate the head space between each layer of jugs 300 and the tray 400 above.

In such a manner a stacked arrangement with a desired number of jugs 300 and trays 400, 500 may be assembled. The height of the stacked arrangement 600 may be limited by the load carrying capability of the jugs being used and/or by the stability of the stacked arrangement 600.

In one particular embodiment of the stacked arrangement 600, the stacked arrangement 600 might comprise four layers of jugs 300, each layer comprising 48 jugs. In this embodiment, the weight of the stacked arrangement 600 would be about 1800 lbs. In one particular embodiment, two trays 400, 500, each holding 24 jugs, are placed next to each other on a pallet side-by-side.

As compared to prior milk crates and shelving units discussed above, the stacked arrangement 600 may provide for one or more of the following advantages: (i) less room being required to transport, hold and display the jugs 300; (ii) a utilization of the load carrying capacity of the jugs; (iii) there may be cost savings passed on to consumers as shipping and handling costs would be less and less room is taken up in a retailer's display case; (iv) the trays may be reusable and/or recyclable; (v) the trays take up less room when empty as compared to prior art crates or shelving units required for the same amount of jugs 300. When compared specifically to the use of the shelving unit discussed above, the trays 400, 500 may be safer, because there are no movable metal shelves.

Features of illustrative embodiments are described in detail above and shown in FIGS. 1 to 15. Variations on these illustrative embodiments are expected.

For instance, the illustrative example trays shown in the drawings and described above include jug receiving cells on a tray top surface. In other embodiments, the top surface, which is to support a bottom of one or more jugs, might not include such cells to receive jugs. The jugs could be supported by the top surface without necessarily having jug receiving cells to receive the base of each jug.

The base support columns as shown at 110, 410 in FIGS. 1 and 11 can provide lateral stability to jugs on the top surface described above. These base support columns and ridges or walls between them represent one example of how jug receiving cells on the top surface could be defined. The base support columns and the walls between them are illustrative of walls extending from the first surface to define jug receiving cells to receive bottom portions of jugs. In other embodiments, such walls need not include base support columns.

Jug receiving cells may contribute to stability of a stack including layers of jugs with trays between the layers. Trays that engage jugs in a lower layer effectively tie the lower layer jugs together laterally, and jug receiving cells could similarly tie the upper layer jugs together laterally. Single-sheet construction of the tray, or another construction in which adjacent jug engaging structures are joined or fastened together, as well as fit between jugs and the tray all contribute to increasing stability of a stacked multi-layer arrangement of jugs and trays.

Lateral stability can thus be enhanced for upper layer jugs on top of a tray by providing jug receiving cells on the top surface. Stability can be further enhanced where the jug receiving cells have a shape that is complementary to a shape of the bottom or base of each jug. Such matching of the jug bottom shape and the jug receiving cell shape can contribute to not only lateral stability, but also to axial stability in keeping jugs aligned in a vertical or axial direction. Maintaining jugs in an upright position, in addition to constraining them from lateral movement, further improves stability of a stacked arrangement.

Vertical or axial alignment could also be important in achieving desired load transfer from upper layer jugs to lower layer jugs. Maintaining alignment can maintain a preferred load distribution across one or more portions of the lower layer jugs. A jug that moves out of alignment might carry more load on its top shoulder and/or cap, for example, than is intended. This can cause deformation of the jug or even a leak or break in the jug.

Jug receiving cell shape could be designed or adapted to provide other features as well. Jug orientation can be controlled, for example, using one or more recesses 314 and one or more corresponding raised portions 414 in each jug receiving cell. The raised portions 414 not only have an orientation control feature, but are also a form of rib which can increase the strength of the seat 404. Additional reinforcement ribs, extending from the top tray surface where corresponding recesses are provided in jug bottoms, or from the bottom tray surface, could be provided to further increase the strength of the seat 404, and one or more ribs could similarly be provided in jug receiving cell walls to increase their strength.

As noted above, reinforcement ribs could be provided on the jugs. These ribs could be inner ribs or outer ribs, and the jug receiving cells could include complementary structures to receive such ribs. For example, if jugs have outer reinforcement ribs as shown in FIG. 9, then the walls of the jug receiving cells could have channels to receive the reinforcement ribs in the bottom portion of the jugs. Without such channels, the jug receiving cell walls could deform the jugs in areas around the reinforcement ribs as a result of forcing the ribbed jug portions into the jug receiving cells, or at least affect the fit between the jugs and the jug receiving cells.

Channels in the jug receiving cell walls to accommodate outer jug ribs, or ribs in the jug receiving cell walls to be received in inner jug ribs, also have a secondary effect of increasing strength of the walls. A channel is in effect a reverse rib, and as noted elsewhere herein a rib can be used to increase strength of a surface. Channels or ribs in the jug receiving cell walls could potentially be avoided by shortening the walls so that they are below the jug ribs, or by shortening the jug ribs to end above the cell walls. However, extending the ribs lower on the jugs improves the strength of the jugs, and increasing the height of the jug receiving cell walls improves stack stability. Therefore, in some embodiments, the jug receiving cell walls include channels or ribs corresponding to jug reinforcement ribs.

The dimensions of the jug receiving cells relative to jug dimensions can also come into play in improving stability of a stacked arrangement. Higher jug receiving cell walls might improve stability, but increasing cell wall height also increases the distance between adjacent jugs and thus the horizontal footprint of a stacked arrangement, which can be a concern where standard sizes of pallets or shipping containers are to be used. There can also be issues for certain tray manufacturing processes. Material distribution can become an issue for a thermal forming process, for example, where a sheet of material is formed into a tray. Higher jug receiving cell walls require more stretching of the sheet, which can result in material thinning at tops of the walls. More stretching can also entail higher temperatures and/or higher cycle times on forming equipment. In some embodiments, jug receiving wall height is actually limited so that jugs can be located closer together. With closer jugs, the jug walls can come into contact with each other, providing a form of interference fit or friction fit between adjacent jugs. This further improves lateral and axial stability without increasing jug receiving cell wall height.

As noted above, forcing a ribbed portion of a jug into a jug receiving cell that does not have channel to accommodate the jug rib(s) can result in jug deformation or at least affect the fit between the jug and the jug receiving cell. There could be similar effects on a jug base even if there are no jug reinforcement ribs or such ribs are accommodated in a jug receiving cell. When a plastic jug is filled with liquid, there is some expansion of the jug. To account for this expansion, the jug receiving cells could be formed to have at least one interior dimension that is larger than a complementary exterior dimension of the bottom portions of the jugs. The filled jugs then have some room to expand into the jug receiving cells rather than having the cells restrict the slight expansion of the jugs and thereby cause jug deformation and/or damage. Such expansion of filled jugs also has side effects of improving the interference or friction fit between each filled jug and its jug receiving cell, and between adjacent filled jugs where adjacent jugs contact each other. There is a trade-off or balance between the amount of expansion and fit that provides minimal deformation and improving structural strength/stability.

Turning now to the tray bottom surface, example trays are described above as having collars extending downwardly therefrom. The collars not only accommodate a jug handle in one or more notches, but they also embody a load transfer feature as well. The weight load of any jugs on the top surface of a tray is transferred to jugs below the tray through the collars. More generally, the collars can be considered an example of load transfer structures extending from a second or bottom surface opposite a first or top surface of the tray, to engage jugs that are arranged below the second surface and transfer at least a portion of a load on the first surface to handles of the jugs. The load transfer to lower layer jugs is at least partially to the jug handles, and need not be a transfer of the entire load to the jug handles.

In a collar embodiment, each load transfer structure has a substantially annular shape to surround a cap of a respective jug. However, separate load transfer structures could be provided. Instead of an annular collar that surrounds a jug cap, one or more lugs or other structures could be provided for each lower layer jug. Where multiple lugs are provided, they could be arranged at locations around where the cap of a jug would be located in a stacked arrangement without completely surrounding the cap. Notches in a collar that do not receive jug handles could extend all the way to the underside of the seat 104, 404 in FIGS. 1 and 11, for example, to provide separate load transfer structures that generally surround the cap of a jug. Other numbers and shapes of load transfer structures are also contemplated. At least one load transfer structure is provided to engage each lower layer jug and transfer a portion of load to the lower layer jug handles. The load transfer structure for each jug could be in the form of a structure to engage each jug handle, a structure such as a collar to engage each jug handle and other parts of each jug, or multiple structures to engage each jug handle and one or more other parts of each jug.

In some embodiments, there could be load transfer structures that have at least one channel to engage the handles of the lower layer jugs. Channels 210 in collar 200 are one example of such channels. Channels could be provided in a lug or other form of load transfer structure, to engage a top and/or shoulder surface of a handle, and possibly also sides of a handle. The load transfer structures could include structures that provide multiple channels to engage the handles of the lower layer jugs in different orientations of the jugs.

A channel need not be provided in every embodiment. For example, where a separate load transfer structure is provided to engage only a handle of each lower layer jug, that load transfer structure could be located and sized to engage the handle without having to provide a channel. Even in a collar embodiment, if the jug shoulders and handle have the same contour or profile for example, then the collar need not have a channel to accommodate the handle, since a continuous surface on each collar can engage both the shoulders and the handle of each jug.

One or more reinforcement ribs, which could be formed as inner ribs/channels or outer ribs, could be provided on a load transfer structure to increase strength, but a channel to accommodate the lower layer jug handles might not be provided in every embodiment. One or more reinforcement ribs could be provided to strengthen any load transfer structures, including those that do not engage jug handles where separate load transfer structures for engaging jug handles and other jug portions are provided.

The load transfer structures could include load transfer structures having a shape that is complementary to a shape of a shoulder portion of the jugs. In a collar embodiment, one or more channels such as 210*a*, 210*d* in FIG. 12 may be provided to engage a handle, one or more reinforcement ribs such as the channels 210*b*, 210*c* in FIG. 12 could also be provided, and other portions of each collar surface may engage a shoulder portion of each jug and have a shape that is complementary to the shape of the shoulder portion. In embodiments in which multiple load transfer structures are provided for each lower layer jug, there could be one or more load transfer structures having a shape that is complementary to a shape of a shoulder portion of the jugs.

As noted above, embodiments may provide for transfer of at least a portion of a load to handles of lower layer jugs. There could also be load transfer to other parts of the lower layer jugs, such as the jug shoulders, by providing load transfer structures with a shape that is complementary to a shape of a jug shoulder. Load could also or instead be transferred to lower layer jug caps through load transfer structures to engage the caps. In some embodiments, the center portion 108, 208 sits above the cap of a lower layer jug so as to avoid load transfer to the cap. In other embodiments, the caps of the lower layer jugs carry part of the upper layer load. The amount of load carried by the lower layer caps can be controlled, for example, by setting relative dimensions of cap engaging load transfer structures or parts and load transfer structures which engage other parts of the lower layer jugs. The small radii at the neck 304 of the example jug 300 shown in FIGS. 5 to 10, for example, tend to have a lower load carrying capacity than other parts of the jug, such as the shoulder 306 which joins to the jug side walls with a much higher radius joint. The handle of a plastic jug also tends to have more material than other parts of a jug and thus also has a higher load carrying capacity. While the cap could carry some load, embodiments herein provide for load transfer to other parts of lower layer jugs, including at least the handles.

Considering the tray as a whole, there are other features that can contribute to load transfer. For example, providing jug receiving cells with a shape that matches the shape of the jug base can improve load distribution on a loaded lower layer jug. Placing a jug on a flat surface or a pallet puts all of the load on parts of the jug that contact the flat surface or pallet. Load distribution can be provided, at least for jugs that do not have a flat base or bottom portion, with a jug receiving cell having a matching surface profile or shape. This could aid in distributing the load through the bottom of a jug to the side panel radius, reducing or possibly even eliminating the likelihood of deformation. As shown perhaps most clearly in FIGS. 9 and 10, for example, the jug side walls are not joined to the jug bottom at continuous perpendicular corners. There is a bottom contour with shoulders, rather than a flat bottom surface. Jug receiving cells can transfer load through those bottom contour surfaces or shoulders to lower layer jugs through the load transfer structures. The load carried by the upper layer jugs need not be entirely transferred to only the bottom surface of each jug, but can instead be distributed among the jug side walls, the bottom contours or shoulders, and the bottom surface. This "upper" load distribution can be controlled, in terms of how much load is carried by each portion of the jug base, by setting dimensions or shapes of parts of the jug receiving cells and/or setting dimensions or shapes of parts of the jug base.

The load transfer to portions of the lower layer jugs is also controllable through dimensioning of the load transfer structures. Area loads are preferable to point loads for plastic jugs, and therefore load transfer structures with engaging surfaces would be preferred over point loading structures. In general, the greatest possible load transfer surface area might be preferred for transferring load to the lower layer jugs. With reference to FIGS. 1 and 11, however, it can be seen that expanding a shoulder-engaging surface of each collar to extend further along a lower jug shoulder would decrease the size of the upper jug seat 104, 404. This represents a trade-off in terms of supporting the upper jug base versus transferring load to the lower jug. Similarly, increasing the engaging surface area between the collar channel and the handle trades off upper jug seat size and support relative to lower jug handle load transfer.

In general, smaller radius corners have lower load bearing capacity than higher radius corners. With reference to FIG. 7, for example, it can be seen that the collar surface which contacts the shoulder 306 of the jug 300 is joined to adjacent collar surfaces at angles of greater than 90 degrees. Although this contact surface could be extended further along the jug shoulder 306 toward the collar outer wall, doing so would decrease the radius of the joint angle between the lower edge of the contact surface and the collar outer wall, thereby decreasing its load bearing capacity. The intermediate surface between the contact surface and the collar outer wall in the example shown in FIG. 7 provides for two larger radius joints rather than one smaller radius joint that might otherwise be provided.

Single-radius inter-surface joints between surfaces are also possible, as shown for the joint between the inner collar wall and the contact surface in FIG. 7, and for both contact surface/collar wall joints in FIG. 8. Even the outer collar wall and the contact surface are joined at a single-radius joint in FIG. 8. This joint, however, has a larger radius than would be possible if the contact surface were extended further along the handle 308 toward the collar outer wall, and/or if the collar outer wall were extended further toward the handle.

Such considerations in terms of joints between surfaces represent further trade-offs in setting load transfer structure dimensions and shapes.

The handle, shoulder, and cap load transfers described above are illustrative of load transfers that could potentially be made in various embodiments. Other embodiments are also contemplated. With reference to FIGS. 6 and 8, for example, it can be seen that a collar channel 210 could engage and transfer load to a jug handle 308. Parts of the collar, or a load transfer structure that engages the handle 308, could extend below the handle, to engage and transfer load to the side wall in front of the handle and/or even to the shoulder wall at the base of the handle.

Jugs and one or more trays could be stacked to form a stacked arrangement, with one or more jugs on the top surface of a tray and multiple jugs below the bottom surface of the tray. The stacked arrangement could be sized, for example, to fit on a standard pallet and/or for display in a retail setting according to retailer specifications. A stacked arrangement could include two or more layers, with a respective tray between each pair of adjacent layers.

Embodiments are described above primarily in the context of trays and stacked arrangements of trays and jugs. Other embodiments, in the form of methods for instance, are also possible.

Figure 16:
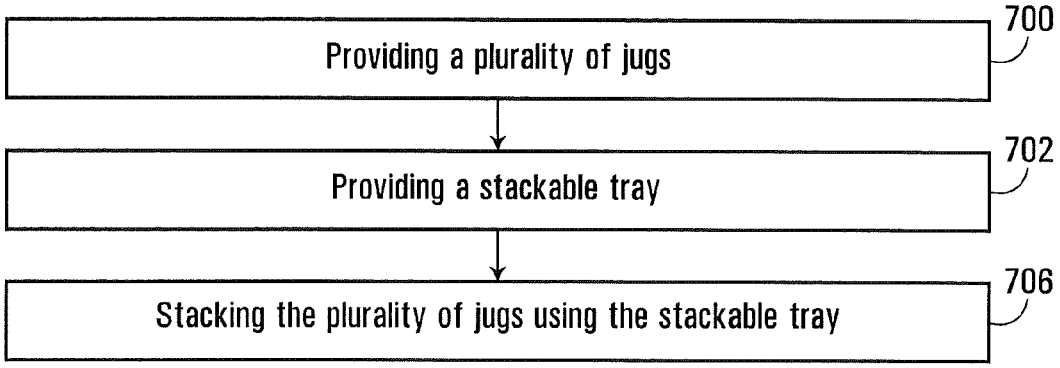
FIG. 16 is a flow chart illustrating an example method.

Referring now to FIG. 16, there is provided an example method of stacking jugs. At 700 a plurality of jugs is provided. At 702, a stackable tray is provided. The stackable tray may be a tray as shown in the embodiments in FIGS. 1 to 15 or otherwise disclosed herein. At 706 the jugs are stacked in multiple layers using the stackable tray.

FIG. 16 is illustrative of an example method. Variations are possible. In some embodiments, for example, a bottom-most tray below a bottom-most layer of jugs of the stacked arrangement has a top surface with jug receiving cells and a bottom surface which is free of collars. The providing at 702 could therefore involve providing stackable trays of different types, including one tray type to hold a first layer of jugs and a second tray type to hold each higher layer of jugs.

It should also be appreciated that the providing at 700, 702 need not necessarily involve manufacturing the jugs and/or the trays. A packaging entity might source the jugs and/or trays from one or more manufacturers, to thereby "provide" the jugs and trays at 700, 702 for use in the stacking at 706. A product packer or shipper could purchase or otherwise provide the jugs and/or trays. "Providing" is not in any way intended to require manufacturing or otherwise making jugs or trays.

Illustrative embodiments are described above and shown in the drawings. Other variations, modifications and improvements may be possible and are included within the scope of the present disclosure. For instance, in some embodiments, the trays may contain holes to allow for drainage of liquids used to wash the tray if they get dirty. In yet other embodiments, the trays may contain holes, handles or notches cut into side walls of the trays to allow for picking up and handling. In still further embodiments, different trays may have different colours or be formed with embossments or other features to identify or label the trays, and in particular, to indicate what product is being held on the tray. For instance, a tray may be the same colour as the labelling of the milk jugs or jugs being contained in the tray. This colour may also or instead indicate the type of milk being sold, for instance, red for homogenized milk, blue for 2% milk and white for skim milk. The trays may also be produced by a variety of manufacturing methods in addition to or instead of those already disclosed. In one embodiment, the trays may be made of cross-hatched plastic similar to milk crates. This may save on material and/or costs. In some aspects, there may be provided a tray for cartons containing liquid.

In yet other embodiments, the trays may include features to assist a clamp truck and/or robotic means in picking up and moving the empty stack of nesting trays or the loaded stacking assembly. The trays may also be used multiple times and re-loaded at a production facility. In such a case, the trays may include features for improved cleaning of the trays e.g. smooth surfaces, sufficiently large radii at corners and edges to improve cleaning, features for self draining in a vertical orientation, features for conveying through a washing machine etc. The trays may include coatings and/or materials for improved moisture resistance, and/or anti-microbial coatings and/or materials.

In some embodiments, the trays may include features which aid automated palletization. Alternatively, or additionally, some features discussed above may aid in automated palletization. The trays may also include features on the underside of the tray to aid conveying, transporting, storing and displaying full pallets for retail purposes.

In a plastic jug, the plastic material may have a certain ability to support some load. The load bearing capacity could be increased by such measures as increasing plastic weight and/or adding reinforcement ribs, which could include outward ribs or inward ribs (also referred to herein as channels). A filled jug could have an even greater load carrying capacity. Although milk jugs are normally capped without an additional internal seal, the mouth of a jug could be sealed, with an induction seal for example, to provide an airtight jug. Such a seal could be an aid in increasing jug load carrying capacity, but need not be provided in all embodiments.

Some embodiments are intended to receive milk jugs of the type ordinarily sold in Canada. In Canada a milk jug has a height of approximately 10 inches and a base of approximately 6 by 6 inches with a capacity of approximately 4 L. Other countries employ other size milk jugs, and the configuration of the trays and the features of the cells and/or collars (i.e., their shape, contour, size and/or orientation) as described herein would be different to accommodate these differently sized jugs. Thus, what has been described is merely illustrative of application of the principles of the present disclosure. Other arrangements can be implemented by those skilled in the art.

The invention claimed is:

1. A stackable tray comprising:

a first surface to support a bottom of one or more jugs;

a plurality of load transfer structures extending from a second surface opposite the first surface, to engage a plurality of jugs arranged below the second surface and transfer at least a portion of a load on the first surface to handles of the plurality of jugs, wherein each load transfer structure of the plurality of load transfer structures has a shape comprising: a first recess to receive an upper portion of a jug of the plurality of jugs; and at least two channels, wherein, each of the at least two channels extends from the first recess outward along the load transfer structure to a periphery of the load transfer structure, and wherein the at least two channels are configured to engage a handle of the jug in a respective one of different orientations of the jug and to transfer the portion of the load on the first surface to the handle of the jug; and walls extending from the first surface, wherein the walls define a plurality of jug receiving cells to receive bottom portions of a second plurality of jugs, each jug receiving cell corresponding to a respective load transfer structure of the plurality of load transfer structures and comprising a second recess having a shape complementary to the shape of the respective load transfer structure, and wherein, in each jug receiving cell, the first surface comprises a first surface portion that forms a seat and a second surface portion that forms a center portion, the first and second surface portions being substantially co-planar and discontinuous.

2. The stackable tray of claim 1, each of the plurality of load transfer structures having a substantially annular shape to surround a cap of a respective one of the plurality of jugs.

3. The stackable tray of claim 1, the plurality of load transfer structures further comprising load transfer structures which have one or more reinforcement ribs to strengthen the load transfer structures.

4. The stackable tray of claim 1, further comprising at least one support column extending from the first surface.

5. The stackable tray of claim 1, the plurality of load transfer structures comprising load transfer surfaces which have a shape that is complementary to a shape of a shoulder portion of the plurality of jugs.

6. The stackable tray of claim 1, the plurality of load transfer structures comprising load transfer structures to engage caps of the plurality of jugs.

7. The stackable tray of claim 1, the plurality of load transfer structures being adapted to nest at least partially in the plurality of jug receiving cells of another stackable tray when the plurality of jug receiving cells of the other stackable tray are empty.

8. The stackable tray of claim 1, the plurality of jug receiving cells having at least one interior dimension that is larger than a complementary exterior dimension of the bottom portions of the second plurality of jugs.

9. The stackable tray of claim 1, wherein the walls further comprise channels to receive reinforcement ribs in the bottom portions of the second plurality of jugs.

10. The stackable tray of claim 1, wherein the second recess is annularly arranged around the second surface portion and between the first and second surface portions.

11. A stacked arrange comprising:

multiple layers of jugs, each comprising a plurality of jugs;

a respective stackable tray of claim 1, between adjacent layers of the multiple layers.

12. A method comprising:

providing a plurality of jugs;

providing a plurality of stackable trays, each stackable tray comprising the stackable tray of claim 1;

arranging the plurality of jugs in multiple layers, with a respective one of the plurality of stackable trays between adjacent layers of the multiple layers.

13. A stacked arrangement comprising:

a stackable tray comprising:

a first surface to support a bottom of one or more jugs;

a plurality of load transfer structures extending from a second surface opposite the first surface, to engage a plurality of jugs arranged below the second surface and transfer at least a portion of a load on the first surface to handles of the plurality of jugs, wherein each load transfer structure of the plurality of load transfer structures has a shape comprising: a first recess to receive an upper portion of a jug of the plurality of jugs; and at least two channels, wherein each of the at least two channels extends from the first recess outward along the load transfer structure to a periphery of the load transfer structure, and wherein the at least two channels are configured to engage a handle of the jug in more than one orientation of the jug and to transfer the portion of the load on the first surface to the handle of the jug; and walls extending from the first surface, wherein the walls define a plurality of jug receiving cells to receive bottom portions of a second plurality of jugs, each jug receiving cell corresponding to a respective load transfer structure of the plurality of load transfer structures and comprising a second recess having a shape complementary to the shape of the respective load transfer structure, and wherein, in each jug receiving cell, the first surface comprises a first surface portion that forms a seat and a second surface portion that forms a center portion, the first and second surface portions being substantially co-planar and discontinuous;

one or more jugs on the first surface;

a plurality of jugs below the second surface.

14. The stacked arrangement of claim 13, sized for display in a retail setting.

15. The stacked arrangement of claim 13, comprising a plurality of layers of jugs, the plurality of layers of jugs comprising a first layer including the one or more jugs, a second layer including the plurality of jugs, and at least one further layer each including a further plurality of jugs, the stacked arrangement further comprising a respective further tray between each further layer of jugs and another layer of jugs.

16. The stacked arrangement of claim 15 wherein the stackable trays are adapted to at least partially nest when the trays are empty.

17. The stacked arrangement of claim 13, each of the plurality of load transfer structures having a substantially annular shape to surround a cap of a respective one of the plurality of jugs.

18. The stacked arrangement of claim 13, wherein each jug of the plurality of jugs has only one handle and wherein only one channel of the at least two channels engages the handle of the jug in each orientation of the jug.

19. The stacked arrangement of claim 13, wherein when the one or more jugs are received by their respective jug receiving cells, the second recesses in each of the respective jug receiving cells remain void.

20. A stackable tray for jugs comprising:

a top surface having a plurality of jug receiving cells;

a bottom surface having a plurality of collars extending downwardly therefrom, each jug receiving cell of the plurality of jug receiving cells corresponding to a respective collar of the plurality of collars, wherein each collar of the plurality of collars has a shape having: a first recess to receive an upper portion of a respective jug located beneath each collar and at least two notches, wherein each of the at least two notches extends from the first recess outward along the collar to a periphery of the collar, and wherein the at least two notches are sized to receive a portion of a handle of the respective jug for engaging the jug in a respective one of different orientations of the jug and for transferring at least a portion of a load on the top surface to the handle of the jug, wherein each jug receiving cell comprises a second recess having a shape complementary to the shape of the respective collar, and wherein, in each jug receiving cell, the top surface comprises a first surface portion that forms a seat and a second surface portion that forms a center portion, the first and second surface portions being substantially co-planar and discontinuous.

21. A method comprising:

providing a stackable tray comprising:

a first surface to support a bottom of one or more jugs;

a plurality of load transfer structures extending from a second surface opposite the first surface, to engage a plurality of jugs arranged below the second surface and transfer at least a portion of a load on the first surface to handles of the plurality of jugs, wherein each load transfer structure of the plurality of load transfer structures has a shape comprising: a first recess to receive an upper portion of a jug of the plurality of jugs; and at least two channels, wherein each of the at least two channels extends from the first recess outward along the load transfer structure to a periphery of the load transfer structure, and wherein the at least two channels are configured to engage a handle of the jug in a respective one of different orientations of the jug and to transfer the portion of the load on the first surface to the handle of the jug; and walls extending from the first surface, wherein the walls define a plurality of jug receiving cells to receive bottom portions of a second plurality of jugs, each jug receiving cell corresponding to a respective load transfer structure of the plurality of load transfer structures and comprising a second recess having a shape complementary to the shape of the respective load transfer structure, and wherein, in each jug receiving cell, the first surface comprises a first surface portion that forms a seat and a second surface portion that forms a center portion, the first and second surface portions being substantially co-planar and discontinuous;

providing a plurality of jugs;

stacking the plurality of jugs in multiple layers using the stackable tray.

* * * * *